US008164245B2

(12) United States Patent
Nishida et al.

(10) Patent No.: US 8,164,245 B2
(45) Date of Patent: Apr. 24, 2012

(54) PLASMA DISPLAY PANEL AND FIELD EMISSION DISPLAY HAVING ANTI-REFLECTION LAYER COMPRISING PYRAMIDAL PROJECTIONS AND A PROTECTIVE LAYER

(75) Inventors: Jiro Nishida, Kanagawa (JP); Yuji Egi, Kanagawa (JP); Takeshi Nishi, Kanagawa (JP); Shunpei Yamazaki, Tokyo (JP)

(73) Assignee: Semiconductor Energy Laboratory Co., Ltd., Kanagawa-ken (JP)

( * ) Notice: Subject to any disclaimer, the term of this patent is extended or adjusted under 35 U.S.C. 154(b) by 571 days.

(21) Appl. No.: 11/950,760

(22) Filed: Dec. 5, 2007

(65) Prior Publication Data

US 2008/0129184 A1 Jun. 5, 2008

(30) Foreign Application Priority Data

Dec. 5, 2006 (JP) ..... 2006-328213

(51) Int. Cl.
*H01J 1/62* (2006.01)

(52) U.S. Cl. ..... 313/484; 313/483; 313/582; 313/495

(58) Field of Classification Search ..... 313/484, 313/483

See application file for complete search history.

(56) References Cited

U.S. PATENT DOCUMENTS 4,721,361 A 1/1988 van de Ven
4,883,343 A 11/1989 Teshirogi
5,805,252 A 9/1998 Shimada et al.
5,939,826 A 8/1999 Ohsawa et al.
6,255,705 B1 7/2001 Zhang et al.
6,261,665 B1 7/2001 Murata et al.
6,417,831 B2 7/2002 Kashima
6,426,787 B1 7/2002 Satake et al.
6,433,841 B1 8/2002 Murade et al.
6,468,844 B1 10/2002 Yamazaki et al.
6,576,926 B1 6/2003 Yamazaki et al.
6,635,986 B2 * 10/2003 Yaniv et al. ..... 313/495

(Continued)

FOREIGN PATENT DOCUMENTS

JP 07-168006 A 7/1995

(Continued)

OTHER PUBLICATIONS

Derwent entry for JP 2001-288562.*

(Continued)

*Primary Examiner* — Toan Ton
*Assistant Examiner* — Britt D Hanley
(74) *Attorney, Agent, or Firm* — Nixon Peabody LLP; Jeffrey L. Costellia

(57) ABSTRACT

It is an object to provide a plasma display and a field emission display that each have high visibility and an anti-reflection function that can further reduce reflection of incident light from external. Reflection of light can be prevented by having an anti-reflection layer that geometrically includes a plurality of adjacent pyramidal projections. In addition, a plurality of hexagonal pyramidal projections, each of which is provided with a protective layer formed of a material having a lower refractive index than a refractive index of the pyramidal projection so as to fill a space among the plurality of pyramidal projections, can be provided to be packed together without any spaces. Further, six sides of a pyramidal projection face different directions with respect to a base. Therefore, light can be diffused in many directions efficiently.

16 Claims, 28 Drawing Sheets

U.S. PATENT DOCUMENTS

| | | | | |
|---|---|---|---|---|
| 6,717,359 | B2 | 4/2004 | Kimura | |
| 6,777,254 | B1 | 8/2004 | Yamazaki et al. | |
| 6,811,274 | B2 | 11/2004 | Olczak | |
| 6,825,896 | B2 | 11/2004 | Goto et al. | |
| 6,833,665 | B2 | 12/2004 | Wachi et al. | |
| 6,951,400 | B2 | 10/2005 | Chisholm et al. | |
| 7,034,808 | B2 | 4/2006 | Sakata et al. | |
| 7,094,452 | B2 | 8/2006 | Yamashita et al. | |
| 7,151,580 | B2 * | 12/2006 | Ueki et al. | 349/57 |
| 7,248,324 | B2 | 7/2007 | Ono et al. | |
| 7,253,955 | B2 | 8/2007 | Watanabe et al. | |
| 7,259,110 | B2 | 8/2007 | Ohnuma et al. | |
| 7,261,931 | B2 | 8/2007 | Nishikawa et al. | |
| 7,270,883 | B2 | 9/2007 | Kato | |
| 7,297,386 | B2 | 11/2007 | Suzuki et al. | |
| 7,301,264 | B2 | 11/2007 | Ohsawa | |
| 7,659,669 | B2 | 2/2010 | Nishida et al. | |
| 7,695,168 | B2 | 4/2010 | Gueyvandov et al. | |
| 7,781,768 | B2 | 8/2010 | Sakakura et al. | |
| 2001/0030638 | A1 | 10/2001 | Kashima | |
| 2002/0044356 | A1 | 4/2002 | Arakawa et al. | |
| 2002/0101155 | A1 | 8/2002 | Kimura | |
| 2003/0102286 | A1 | 6/2003 | Takahara et al. | |
| 2003/0169386 | A1 | 9/2003 | Goto et al. | |
| 2003/0180476 | A1 | 9/2003 | Yamashita et al. | |
| 2004/0109303 | A1 | 6/2004 | Olczak | |
| 2004/0109305 | A1 | 6/2004 | Chisholm et al. | |
| 2004/0191478 | A1 | 9/2004 | Nishikawa et al. | |
| 2004/0201795 | A1 | 10/2004 | Paukshto | |
| 2004/0227446 | A1 | 11/2004 | Fujumoto et al. | |
| 2005/0030461 | A1 | 2/2005 | Ono et al. | |
| 2005/0053790 | A1 | 3/2005 | Kato | |
| 2005/0074579 | A1 | 4/2005 | Suzuki et al. | |
| 2005/0190321 | A1 | 9/2005 | Ohsawa | |
| 2005/0245078 | A1 | 11/2005 | Ohnuma et al. | |
| 2006/0012736 | A1 | 1/2006 | Nishino et al. | |
| 2006/0050387 | A1 | 3/2006 | Arakawa et al. | |
| 2006/0119269 | A1 | 6/2006 | Park | |
| 2006/0139749 | A1 | 6/2006 | Watanabe et al. | |
| 2006/0172119 | A1 | 8/2006 | Hayashi et al. | |
| 2006/0245060 | A1 | 11/2006 | Goto | |
| 2006/0250064 | A1 | 11/2006 | Park et al. | |
| 2007/0115573 | A1 | 5/2007 | Gueyvandov et al. | |
| 2007/0131928 | A1 | 6/2007 | Kwak et al. | |
| 2007/0284991 | A1 | 12/2007 | Egi et al. | |
| 2008/0001156 | A1 | 1/2008 | Sakakura et al. | |
| 2008/0042926 | A1 | 2/2008 | Egi et al. | |
| 2008/0129183 | A1 | 6/2008 | Egi et al. | |
| 2008/0129188 | A1 | 6/2008 | Egi et al. | |
| 2008/0129933 | A1 | 6/2008 | Nishida et al. | |
| 2008/0130122 | A1 | 6/2008 | Egi et al. | |
| 2008/0144180 | A1 | 6/2008 | Nishida et al. | |
| 2008/0158682 | A1 | 7/2008 | Egi et al. | |
| 2008/0165315 | A1 | 7/2008 | Nishida et al. | |
| 2010/0002306 | A1 | 1/2010 | Goto | |
| 2011/0134647 | A1 | 6/2011 | Nishida et al. | |

FOREIGN PATENT DOCUMENTS

| | | | |
|---|---|---|---|
| JP | 08-297202 | | 11/1996 |
| JP | 08-297202 | A | 11/1996 |
| JP | 2001-264520 | | 9/2001 |
| JP | 2003-177207 | A | 6/2003 |
| JP | 2003-240904 | | 8/2003 |
| JP | 2003-248102 | A | 9/2003 |
| JP | 2003-279705 | | 10/2003 |
| JP | 2003-279705 | A | 10/2003 |
| JP | 2003-295778 | A | 10/2003 |
| JP | 2004-085831 | A | 3/2004 |
| JP | 2004-177781 | | 6/2004 |
| JP | 2004-177781 | A | 6/2004 |
| JP | 2004-291500 | | 10/2004 |
| JP | 2004-291500 | A | 10/2004 |
| JP | 2005-064324 | A | 3/2005 |
| JP | 2005-173457 | A | 6/2005 |
| JP | 2005-181740 | A | 7/2005 |
| JP | 2005-264099 | A | 9/2005 |
| JP | 2006-010831 | A | 1/2006 |
| JP | 2006-509240 | | 3/2006 |
| JP | 2006-133617 | A | 5/2006 |
| JP | 2006-171229 | A | 6/2006 |
| JP | 2006-189784 | | 7/2006 |
| JP | 2006-313360 | | 11/2006 |
| WO | WO-2004/051325 | | 6/2004 |
| WO | WO-2005/010572 | | 2/2005 |
| WO | WO-2005/088355 | | 9/2005 |

OTHER PUBLICATIONS

International Search Report for International Application No. PCT/JP2007/073436, mailed Jan. 8, 2008.

Written Opinion for International Application No. PCT/JP2007/073436 mailed Jan. 8, 2008.

International Search Report ( for International Application No. PCT/JP2007/073432) mailed Jan. 8, 2008.

Written Opinion ( for International Application No. PCT/JP2007/0073432) mailed Jan. 8, 2008.

Written Opinion (Application No. PCT/JP2007/073434; PCT10173) Dated Jan. 6, 2008.

International Search Report (Application No. PCT/JP2007/073434; PCT10173) Dated Jan. 8, 2008.

International Search Report (Application No. PCT/JP2007/073285; PCT10171) Dated Jan. 8, 2008.

Written Opinion (Application No. PCT/JP2007/073285; PCT10171) Dated Jan. 8, 2008.

International Search Report (Application No. PCT/JP2007/073436; PCT10169) Dated Jan. 8, 2008.

Written Opinion (Application No. PCT/JP2007/073436; PCT10169) Dated Jan. 8, 2008.

International Search Report (Application No. PCT/JP2007/073289; PCT10172) Dated Jan. 8, 2008.

Written Opinion (Application No. PCT/JP2007/073289; PCT10172) Dated Jan. 8, 2008.

International Search Report (Application No. PCT/JP2007/073430; PCT10170) Dated Jan. 8, 2008.

Written Opinion (Application No. PCT/JP2007/073430; PCT10170) Dated Jan. 8, 2008.

International Search Report (Application No. PCT/JP2007/073125; PCT10174) Dated Jan. 15, 2008.

Written Opinion (Application No. PCT/JP2007/073125; PCT10174) Dated Jan. 15, 2008.

International Search Report (Application No. PCT/JP2007/073286; PCT10176) Dated Feb. 5, 2008.

Written Opinion (Application No. PCT/JP2007/073286; PCT10176) Dated Feb. 5, 2008.

* cited by examiner

PLASMA DISPLAY PANEL AND FIELD EMISSION DISPLAY HAVING ANTI-REFLECTION LAYER COMPRISING PYRAMIDAL PROJECTIONS AND A PROTECTIVE LAYER

TECHNICAL FIELD

The present invention relates to a plasma display panel and a field emission display that each have an anti-reflection function.

BACKGROUND ART

In various displays (a plasma display panel (hereinafter referred to as a PDP), a field emission display (hereinafter referred to as an FED), and the like), there may be a case where it becomes difficult to see an image of a display screen due to reflection of its surroundings by surface reflection of incident light from external so that visibility is decreased. This is a considerable problem, particularly in regards to an increase in the size of the display device or outdoor use thereof.

In order to prevent such reflection of incident light from external, a method for providing display screens of a PDP and an FED each having an anti-reflection film has been employed. For example, there is a method for providing an anti-reflective film that has a multilayer structure of stacked layers having different refractive indexes so as to be effective for a wide wavelength range of visible light (see, for example, Reference 1: Japanese Published Patent Application No. 2003-248102). With a multilayer structure, incident lights from external reflected at each interface between the stacked layers interfere with canceling each other out, which provides an anti-reflection effect.

As an anti-reflection structure, minute cone-shaped or pyramid-shaped protrusions are arranged over a substrate and reflectance of the surface of the substrate is decreased (see, for example, Reference 2: Japanese Published Patent Application No. 2004-85831).

DISCLOSURE OF INVENTION

However, with the above-described multilayer structure, lights which cannot be cancelled in the lights from external reflected at interfaces are emitted to the viewer side as reflected light. In order to achieve mutual cancellation of incident lights from external, it has been necessary to precisely control optical characteristics of materials, thicknesses, and the like of films stacked, and it has been difficult to perform anti-reflection treatment for all incident lights from external which are incident from various angles. In addition, a cone-shaped or pyramid-shaped anti-reflection structure has not had a sufficient anti-reflection function.

In view of the foregoing, a conventional anti-reflection film has a functional limitation, and a PDP and an FED that each have a higher anti-reflection function have been demanded.

It is an object of the present invention to provide a PDP and an FED that each have high visibility and an anti-reflection function that can further reduce reflection of incident light from external.

The present invention provides a PDP and an FED that each have an anti-reflection layer which can prevent reflection of light by geometrically including a plurality of adjacent projections having a pyramid shape (hereinafter referred to as pyramidal projections). One feature of the present invention is to change a refractive index for incident light from external by a physical shape which is a pyramidal projection protruded toward the outside (an air side) from a surface of a substrate that is to serve as a display screen. In addition, another feature is to provide a protective layer formed of a material having a lower refractive index than a refractive index of the pyramidal projection so as to fill a space among a plurality of pyramidal projections. The space among the plurality of pyramidal projections refers to a depression formed by arrangement of pyramidal projections.

As the pyramidal projection, a projection having a pyramidal shape with a hexagonal base (hereinafter also referred to a hexagonal pyramidal projection) is preferable. A plurality of hexagonal pyramidal projections can be packed together without any spaces and light can be diffused in many directions efficiently because six side surfaces of a pyramidal projection face different directions with respect to a base. The periphery of one pyramidal projection is surrounded by other pyramidal projections, and each side of the base forming a pyramidal shape in one pyramidal projection is shared with the base forming a pyramidal projection in another adjacent pyramidal projection.

A projection having a pyramidal shape with a hexagonal base in an anti-reflection layer of the present invention can have a close-packed structure without any spaces and light can be diffused in many directions efficiently because a pyramidal projection with such a shape has the largest number of side surfaces of a pyramidal projection. Therefore, the projection having a pyramidal shape with a hexagonal base in an anti-reflection layer of the present invention has a high anti-reflection function.

As for the anti-reflection layer of the present invention, it is preferable that the distance between apexes of a plurality of pyramidal projections be 350 nm or less and the height of the plurality of pyramidal projections be 800 nm or higher. Further, the filling factor (a filling (occupying) percentage over a substrate that is to serve as a display screen) of bases of the plurality of pyramidal projections per unit area over a substrate that is to serve as a display screen is preferably 80% or more, and more preferably, 90% or more. The filling factor is the percentage of the total area that is covered by the formation region of the hexagonal pyramidal projection in the substrate to serve as the display screen. When the filling factor is 80% or more, a ratio of a planar portion where a hexagonal pyramidal projection is not formed over the substrate that is to serve as a display screen is 20% or less. In addition, it is preferable that the ratio between the height and the width of a base of a pyramidal projection be 5 or more to 1.

In the present invention, the thickness of the protective layer, which is provided to fill a space among a plurality of pyramidal projections, may be equivalent to the height of the pyramidal projection or may be higher than the height of the pyramidal projection to cover the pyramidal projection. In this case, surface unevenness due to the pyramidal projections is planarized by the protective layer. Alternatively, the thickness of the protective layer may be less than the height of the pyramidal projection, and in this case, the portion of the pyramidal projection closer to the side of the base is selectively covered and the portion of the projection closer to the apex is exposed on the surface.

The pyramidal projection can further reduce reflection of incident light from external because of its shape. However, when there is a foreign substance such as dirt or dust in the air among the pyramidal projections, the foreign substance causes reflection of incident light from external, and accordingly, there is a case where a sufficient anti-reflection effect for incident light from external cannot be obtained. Since the protective layer is formed in the space among the pyramidal projections in the present invention, the entry of a contaminant such as dust into the space among the pyramidal projections can be prevented. Therefore, a decrease in anti-reflection function due to the entry of dust or the like can be prevented, and physical strength of the anti-reflection film can be increased by filling a space among the pyramidal projections. Accordingly, reliability can be improved.

Since the protective layer filling the space among the pyramidal projections is formed using a material having a lower refractive index than a material used for the pyramidal projections, the difference between the refractive index of the air and that of the protective layer is lower than the difference between the refractive index of the air and that of the material used for the pyramidal projections, and reflection at interfaces can be further suppressed.

The present invention can provide a PDP and an FED that each have an anti-reflection layer including a plurality of adjacent pyramidal projections, and as a result, the present invention can provide a high anti-reflection function.

In the present invention, the PDP includes a main body of a display panel having a discharge cell and a display device to which a flexible printed circuit (FPC) and/or a printed wiring board (PWB) that are/is provided with one or more of an IC, a resistor, a capacitor, an inductor, and a transistor is attached. In addition, an optical filter having an electromagnetic field shielding function or a near infrared ray shielding function may be included.

The FED includes a main body of a display panel having a light-emitting cell and a display device to which a flexible printed circuit (FPC) and/or a printed wiring board (PWB) that are/is provided with one or more of an IC, a resistor, a capacitor, an inductor, and a transistor is attached. In addition, an optical filter having an electromagnetic field shielding function or a near infrared ray shielding function may be included.

The PDP and the FED of the present invention are each provided with an anti-reflection layer having a plurality of pyramidal projections arranged without any spaces on a surface. Since a side surface of a pyramidal projection is not parallel to a display screen, incident light from external is not reflected to a viewer side but is reflected to another adjacent pyramidal projection or travels among the pyramidal projections. In addition, hexagonal pyramidal projections have a close-packed structure without any spaces and have an optimal shape having the largest number of side surfaces of a pyramidal projection among such shapes and a high anti-reflection function that can diffuse light in many directions efficiently. One part of incident light enters pyramidal projections, and the other part of the incident light is then incident on an adjacent pyramidal projection as reflected light. In this manner, incident light from external reflected at the surface of the side of a pyramidal projection is repeatedly incident on adjacent pyramidal projections.

In other words, of the incident light from external that is incident on the anti-reflection layer, the number of times that the light is incident on the pyramidal projections of the anti-reflection layer is increased; therefore, the amount of incident light from external entering the pyramidal projection of the anti-reflection layer is increased. Thus, the amount of incident light from external reflected to a viewer side can be reduced, and the cause of reduction in visibility such as reflection can be prevented.

Furthermore, since the protective layer is formed in the space among the pyramidal projections in the present invention, the entry of a contaminant such as dust into the space among the pyramidal projections can be prevented. Therefore, a decrease in an anti-reflection function due to the entry of dust or the like can be prevented, and physical strength of the PDP and the FED can be increased by filling the space among the pyramidal projections. Accordingly, reliability can be improved.

Accordingly, a PDP and an FED that each have higher quality and higher performance can be manufactured.

BEST MODE FOR CARRYING OUT THE INVENTION

Figure 1A:
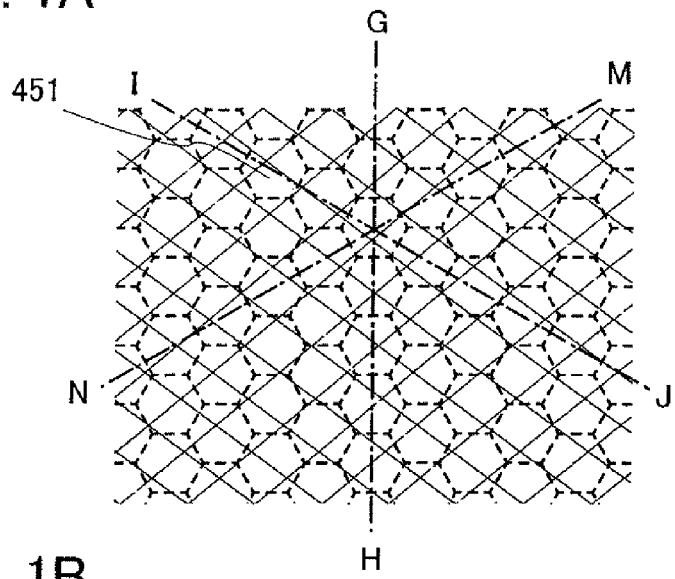
FIGS. 1A to 1D are schematic diagrams of the present invention.

Hereinafter, embodiment modes of the present invention will be described with reference to the accompanying drawings. However, the present invention can be implemented in various modes. As can be easily understood by those skilled in the art, the modes and details of the present invention can be changed in various ways without departing from the spirit and scope of the present invention. Thus, the present invention should not be interpreted as being limited to the following description of the embodiment modes. Note that the same reference numeral may be used to denote the same portions or portions having similar functions in different diagrams for explaining the structure of the embodiment modes with reference to drawings, and repetitive explanation thereof is omitted.

Embodiment Mode 1

In this embodiment mode, an example of an anti-reflection layer for the purpose of having an anti-reflection function that can further reduce reflection of incident light from external and increasing visibility will be described.

Figure 1B:
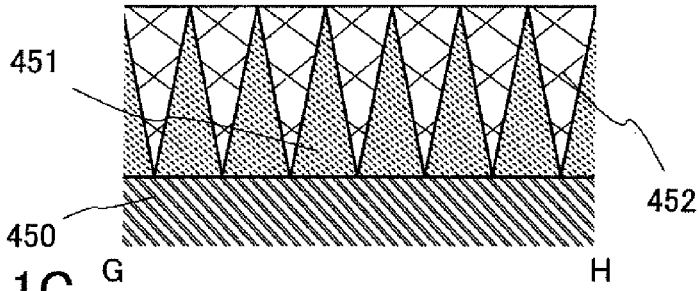
Figure 1C:
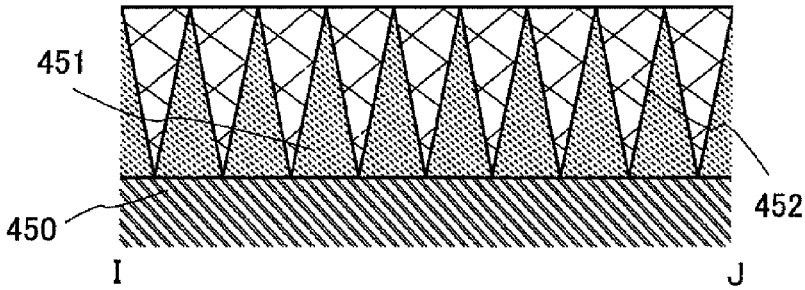
Figure 1D:
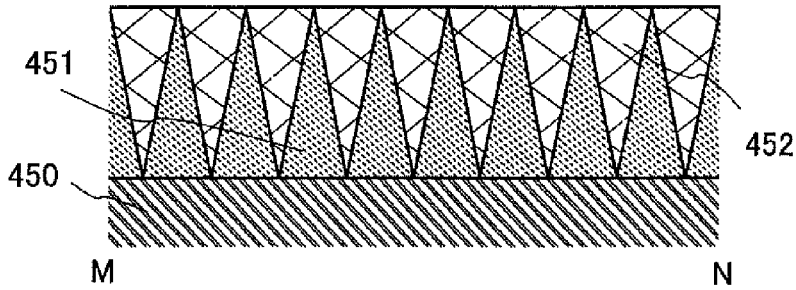

FIG. 1A shows a top view of an anti-reflection layer of this embodiment mode that uses the present invention, and FIGS. 1B to 1D each show a cross-sectional view of an anti-reflection layer of this embodiment mode that uses the present invention. In FIGS. 1A to 1D, a plurality of hexagonal pyramidal projections 451 and a protective layer 452 are provided over a substrate that is to serve as a display screen of a PDP or an FED 450. The anti-reflection layer is formed of the plurality of hexagonal pyramidal projections 451 and the protective layer 452. FIG. 1A is a top view of a PDP or an FED of this embodiment mode. FIG. 1B is a cross-sectional view taken along line G-H from FIG. 1A. FIG. 1C is a cross-sectional view taken along line I-J from FIG. 1A. FIG. 1D is a cross-sectional view taken along line M-N from FIG. 1A. As shown in FIGS. 1A to 1D, the pyramidal projections 451 are provided adjacent to each other so as to fill the surface of the substrate that is to serve as the display screen. Note that the display screen here is referred to as a surface of a substrate provided on the side closest to the viewer side of a plurality of substrates forming a display device.

As for the anti-reflection layer, incident light from external is reflected to a viewer side when there is a planar portion (a surface parallel to a display screen) with respect to incident light from external; therefore, a small planar portion has a higher anti-reflection function. In addition, it is preferable that a surface of the anti-reflection layer be formed of a plurality of side surfaces of pyramidal projections which face in different directions for further diffusing incident light from external.

The hexagonal pyramidal projections in this embodiment mode can have a close-packed structure without any spaces and each of the hexagonal pyramidal projections has an optimal shape among such shapes, having the largest number of side surfaces of a pyramidal projection and a high anti-reflection function that can diffuse light in many directions efficiently.

The plurality of pyramidal projections all come into contact with each other so as to be geometrically continuous, and each side of the base of one pyramidal projection comes into contact with one side of the base of another adjacent pyramidal projection. Therefore, as shown in FIG. 1A in this embodiment mode, the plurality of pyramidal projections covers the surface of the substrate that is to serve as a display screen without any spaces between the pyramidal projections. Accordingly, as shown in FIGS. 1B to 1D, there is no planar portion which is parallel to the display screen because the surface of the substrate is covered by the plurality of pyramidal projections, and incident light from external enters a slanting surface of the plurality of pyramidal projections; thus, reflection of incident light from external on the planar portion can be reduced. Since there are many side surfaces of a pyramidal projection each having different angles with respect to the base of the pyramidal projection, incident light is further diffused in many directions, which is preferable.

Furthermore, the hexagonal pyramidal projection comes into contact with vertexes of bases of the plurality of hexagonal pyramidal projections at the vertexes of the base, and is surrounded by a plurality of side surfaces of pyramidal projections which face in different directions with respect to a base; therefore, light can be easily reflected in many directions. Accordingly, the hexagonal pyramidal projection having many vertexes on the base achieves a high anti-reflection function.

Since all of the plurality of pyramidal projections 451 of this embodiment mode are provided at equal distances from the vertexes of the adjacent plurality of pyramidal projections, a cross section having the same shape as that shown in FIGS. 1B to 1D is provided.

Figure 3A:
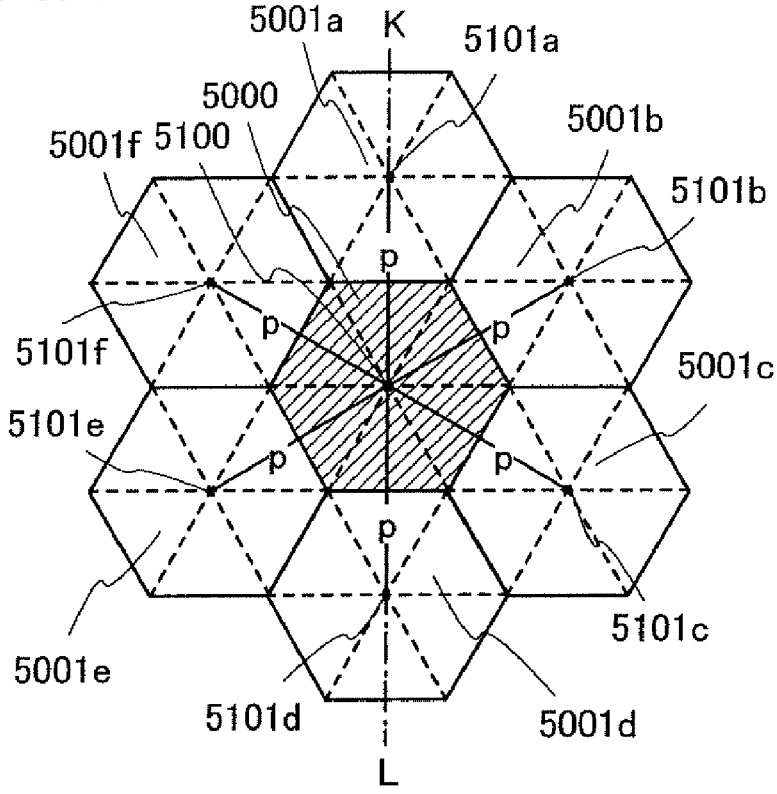
FIGS. 3A and 3B are schematic diagrams of the present invention.
Figure 3B:
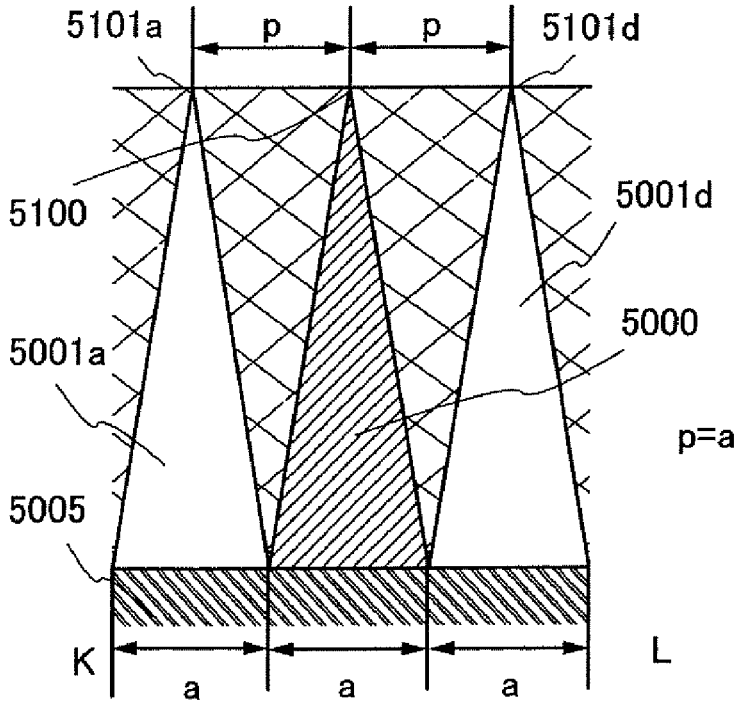

FIG. 3A shows a top view of an example of pyramidal projections of the present invention which are adjacent to each other to be packed together, and FIG. 3B shows a cross-sectional view taken along a line K-L from FIG. 3A. A hexagonal pyramidal projection 5000 comes into contact with a side of a base (a side of a base forming a hexagon) of each of surrounding pyramidal projections 5001*a* to 5001*f*. Further, a base of each of the pyramidal projection 5000 and the pyramidal projections 5001*a* to 5001*f* which are packed around the pyramidal projection 5000 is a regular hexagon, and perpendiculars from an apex 5100 and apexes 5101*a* to 5101*f* cross the center of the regular hexagons of the bases of hexagonal pyramidal projections 5000 and 5001*a* to 5001*f*, respectively. Therefore, the distances from the apex 5100 of the pyramidal projection 5000 and the apexes 5101*a* to 5101*f* of the adjacent pyramidal projections 5001*a* to 5001*f* are equal to each other. In this case, as shown in FIG. 3B, the distance p between apexes of the pyramidal projections and a width a of the pyramidal projection are equal to each other.

Figure 25A:
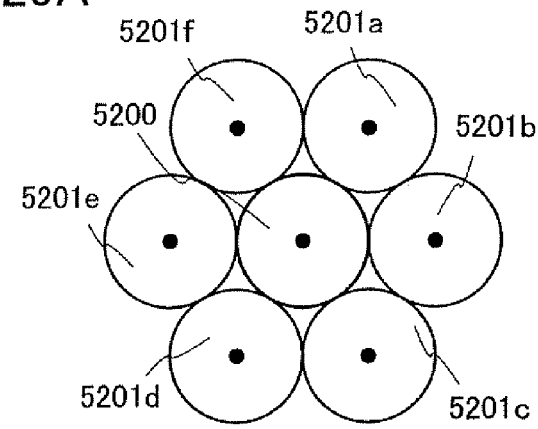
FIGS. 25A to 25C are diagrams showing an experimental model of a comparative example.
Figure 25B:
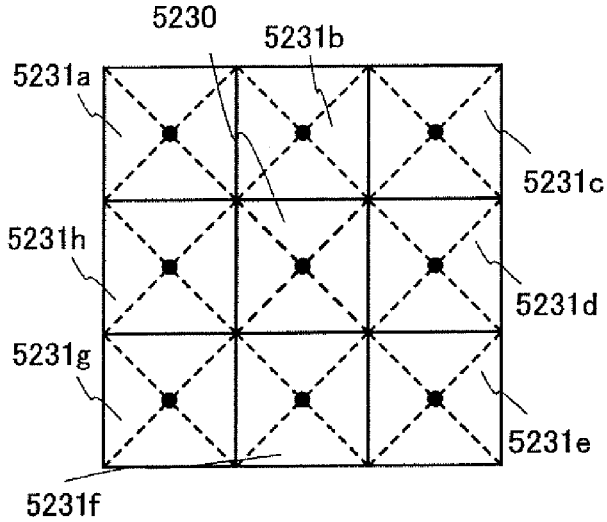
Figure 25C:
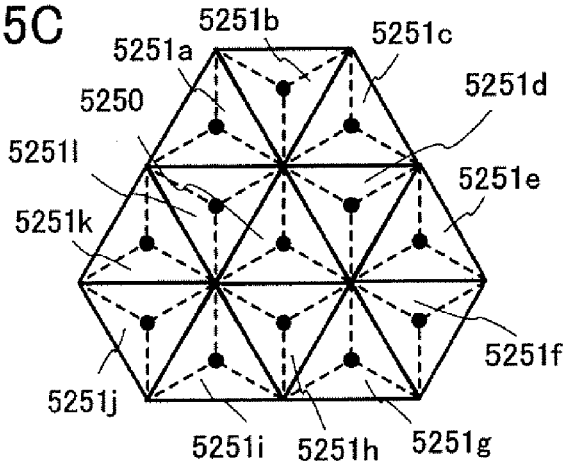

As comparative examples, FIG. 25A shows a case where conical projections of the same shape are provided adjacent to each other; FIG. 25B shows a case where quadrangular pyramidal projections of the same shape are provided adjacent to each other; and FIG. 25C shows a case where triangular pyramidal projections of the same shape are provided adjacent to each other. FIG. 25A shows a structure in which conical projections are packed together; FIG. 25B shows a structure in which quadrangular pyramidal projections are packed together; and FIG. 25C shows a structure in which triangular pyramidal projections are packed together. FIGS. 25A to 25C are top views in which the conical or pyramidal projections are seen from an upper surface. As shown in FIG. 25A, around a conical projection 5200 which is located around the center, conical projections 5201*a* to 5201*f* are arranged having a close-packed structure. However, even when a close-packed structure is used, a base is a circle; therefore, there is a space among the conical projection 5200 and the conical projections 5201*a* to 5201*f*; and a planar portion of a substrate that is to serve as a display screen is exposed. Since incident light from external is reflected from the planar portion to a viewer side, an anti-reflection function of adjacent anti-reflection films of the conical projection is reduced.

In FIG. 25B, quadrangular pyramidal projections 5231*a* to 5231*h* are arranged to be packed together in contact with a square of a base of a quadrangular pyramidal projection 5230 which is located at the center. In a similar manner, in FIG. 25C, triangular pyramidal projections 5251*a* to 5251*l* are arranged to be packed together in contact with a regular triangle of a base of a triangular pyramidal projection 5250, which is located at the center. Since the number of side surfaces of the quadrangular pyramidal projection and the triangular pyramidal projection is lower than that of a hexagonal pyramidal projection, light is not easily diffused in many directions. Although distances between apexes of adjacent hexagonal pyramidal projections can be arranged to be equal, quadrilateral pyramidal projections or regular-triangular pyramidal projections in the comparative examples cannot be arranged so that all of the distances between apexes of the pyramidal projections shown by dotted lines in FIGS. 25A to 25C be equal to each other.

Figure 26:
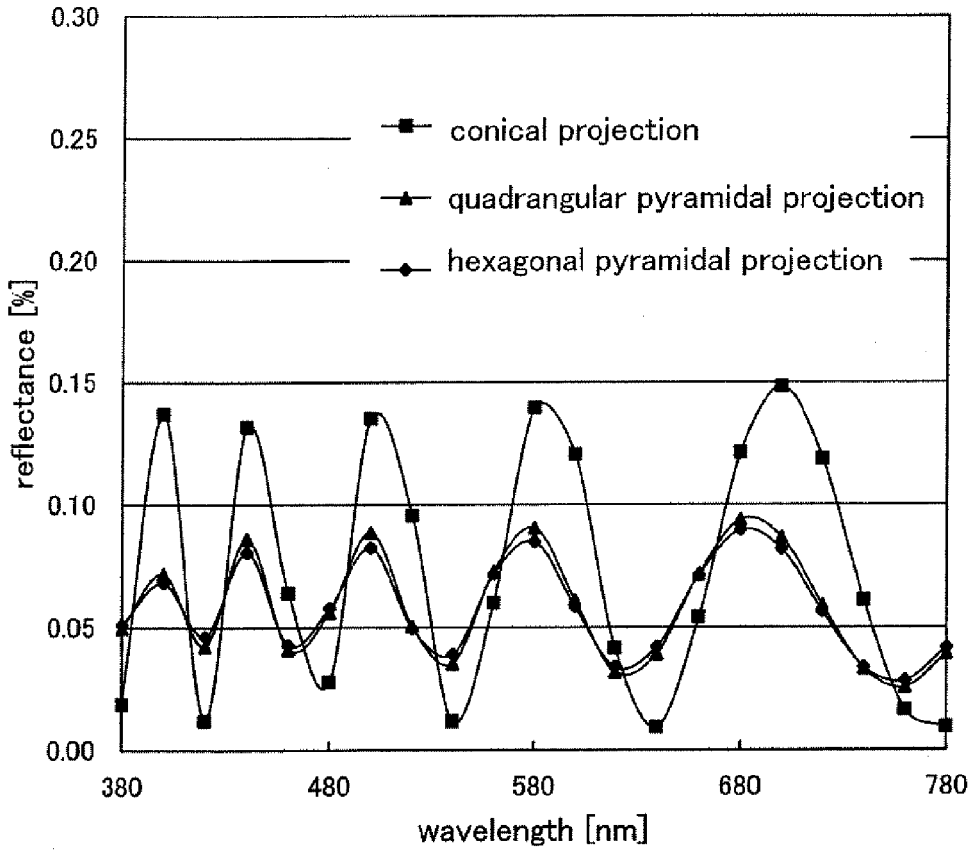
FIG. 26 is a graph showing experimental data of Embodiment Mode 1.

As for the conical projection, the quadrangular pyramidal projection, and the hexagonal pyramidal projection of this embodiment mode, the results of optical calculations are shown hereinafter. Note that as for the conical projection, the quadrangular pyramidal projection, and the hexagonal pyramidal projection of this embodiment mode, a depression formed by providing pyramidal projections is filled by a protective layer. The calculation in this embodiment mode is made by using Diffract MOD (made by RSoft Design Group, Inc.), an optical calculation simulator for optical devices. The calculation of reflectance is made by performing optical calculation in three-dimensions. FIG. 26 shows a relationship between the wavelength of light and reflectance in each of the conical projection, the quadrangular pyramidal projection, and the hexagonal pyramidal projection. As calculation conditions, Harmonics, which is a parameter of the above calculation simulator, is set to be 3 for both X and Y directions. In addition, in the case of using a conical projection or a hexagonal pyramidal projection, when the distance between apexes of the conical projections or the hexagonal pyramidal projections is p and a height of the conical projection or the hexagonal pyramidal projection is b, Index Res., which is a parameter of the above calculation simulator, is set as follows: a numerical value for the X direction is calculated by ($\sqrt{3}\times p/128$); a numerical value for the Y direction is calculated by ($p/128$); and a numerical value for the Z direction is calculated by ($b/80$). In the case of using the quadrilateral pyramidal projection as shown in FIG. 25B, when the distance between apexes of the quadrilateral pyramidal projections is q, Index Res., which is a parameter of the above calculation simulator, is set as follows: a numerical value for each of the X direction and the Y direction is calculated by ($q/64$); and a numerical value for the Z direction is calculated by ($b/80$).

In FIG. 26, the square data marker denotes the data for the conical projections, the triangular data marker denotes the data for the quadrangular pyramidal projections, and the diamond-shaped data marker denotes the data for the hexagonal pyramidal projections, and each shows the relationship between wavelength and reflectance. From the optical calculation results, it can be confirmed that the model in which the hexagonal pyramidal projections of this embodiment mode which are packed together shows a smaller variation width of reflectance with change of wavelength and lower reflectance on average than comparative examples in which the conical projections or the quadrangular pyramidal projections are packed together, in a wavelength range of 380 nm to 780 nm, and the reflectance can be greatly reduced. Note that the refractive indexes, the heights, and the widths of the conical projection, the quadrangular pyramidal projection, and the hexagonal pyramidal projection are all 1.492, 1500 nm, and 300 nm, respectively. In addition, the refractive index of a protective layer is 1.05, and the protective layer covers a projection up to its apex so that unevenness caused by the conical projection or pyramidal projection is planarized.

When the filling factor of the bases of a plurality of hexagonal pyramidal projections per unit area in a surface of a display screen (that is, the surface of the substrate that is to serve as a display screen) is 80% or more, preferably 90% or more, since the ratio of incident light from external which is incident on a planar portion is reduced, incident light from external can be prevented from being reflected to a viewer side, which is preferable. The filling factor is the percentage of the total area of the substrate that is to serve as the display screen that is covered by the formation region of the hexagonal pyramidal projection. When the filling factor is 80% or more, the ratio of the planar portion where the hexagonal pyramidal projection is not formed over the substrate that is to serve as a display screen is 20% or less.

Figure 27:
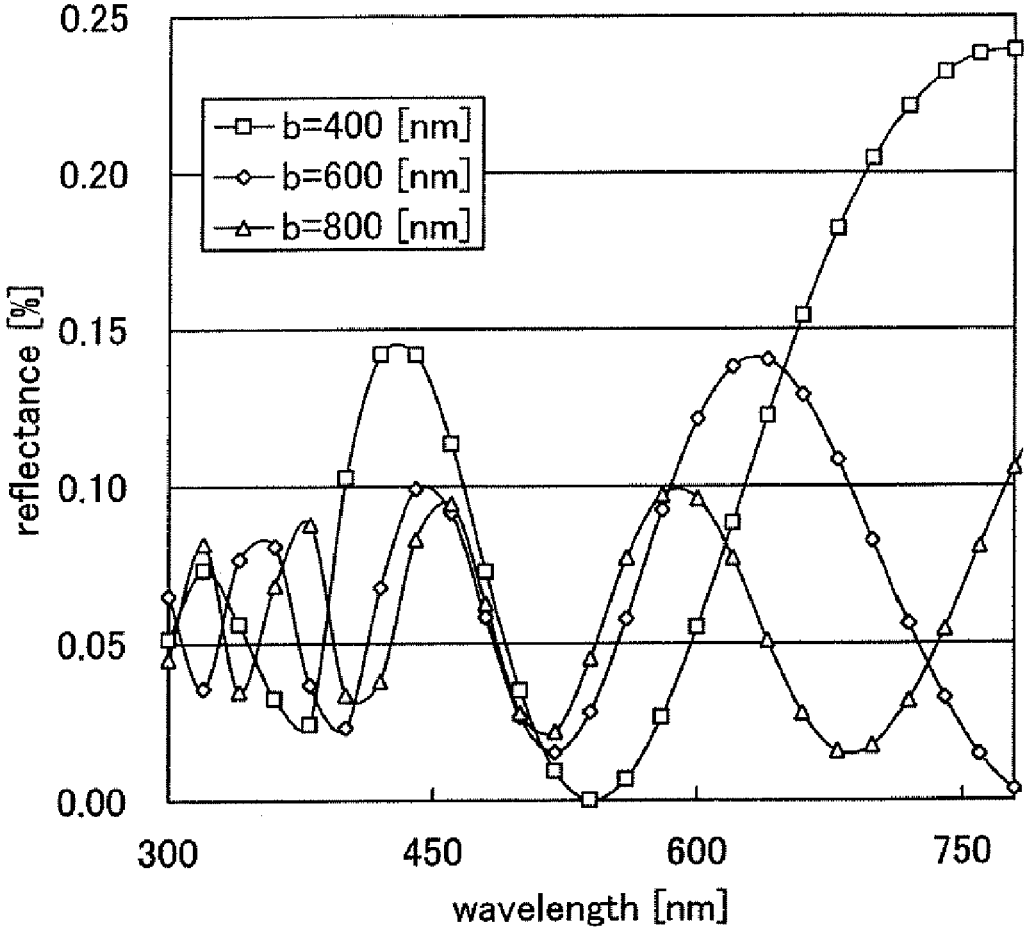
FIG. 27 is a graph showing experimental data of Embodiment Mode 1.

Similarly, in the model in which the hexagonal pyramidal projections are packed together, the calculation results for changes, caused by changing the width a and the height b of the hexagonal pyramidal projection, in the reflectance with respect to each wavelength is shown hereinafter. In FIG. 27, the change in reflectance with respect to light of some wavelengths is shown at the time when the width a of the hexagonal pyramidal projection is 300 nm, and in the cases that the heights b are 400 nm (square data marker), 600 nm (diamond-shaped data marker), and 800 nm (triangular data marker). As the height b increases from 400 nm, through 600 nm, and to 800 nm, reflectance decreases in accordance with measured wavelengths. In the case where the height b is 800 nm, reflectance variation with wavelengths is also decreased, and reflectance is about 0.1% or less in the full range of measured wavelengths, which is in the visible light region.

Figure 28:
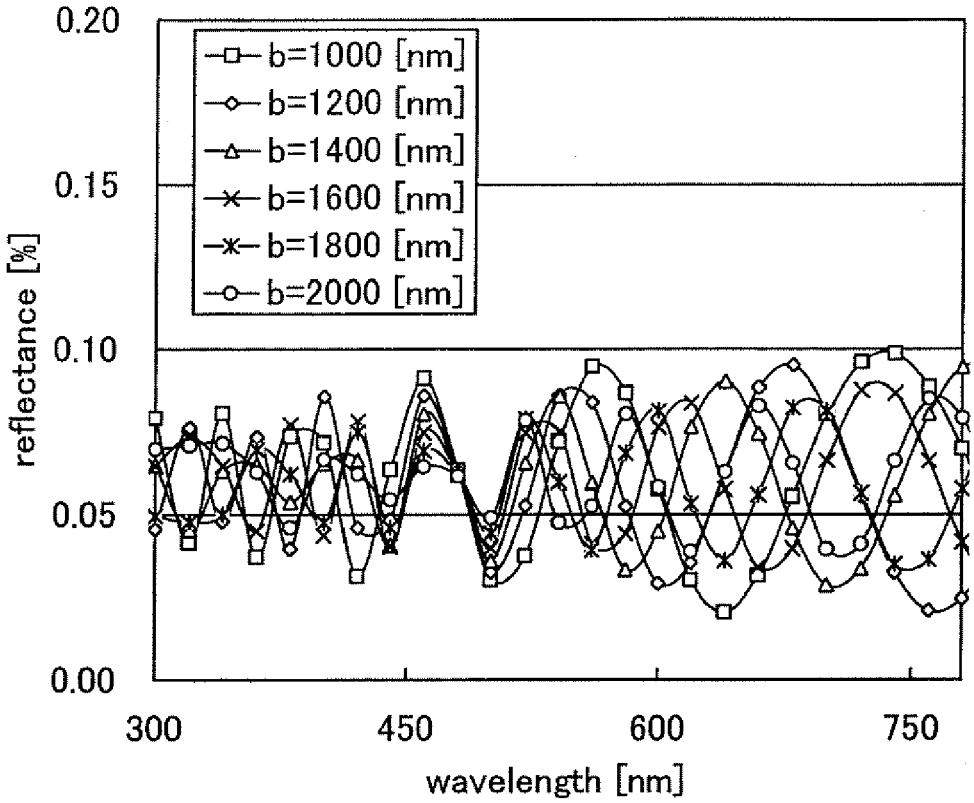
FIG. 28 is a graph showing experimental data of Embodiment Mode 1.

Furthermore, FIG. 28 shows results of optical reflectance calculations with respect to light of some wavelengths at the time when the width a of the hexagonal pyramidal projection is 300 nm, and the height b is changed among 1000 nm (square data marker), 1200 nm (diamond-shaped data marker), 1400 nm (triangular data marker), 1600 nm (x -shaped data marker), 1800 nm (asterisk data marker), and 2000 nm (circular data marker). As shown in FIG. 28, reflectance for the measured wavelengths (300 nm to 780 nm) is suppressed to as low as 0.1% or lower when the width a is 300 nm and the height b is 1000 nm or higher. When the height b is 1600 nm or higher, the variation width with change of wavelengths is small, and reflectance is suppressed to be low on average for all measured wavelengths.

Figure 29:
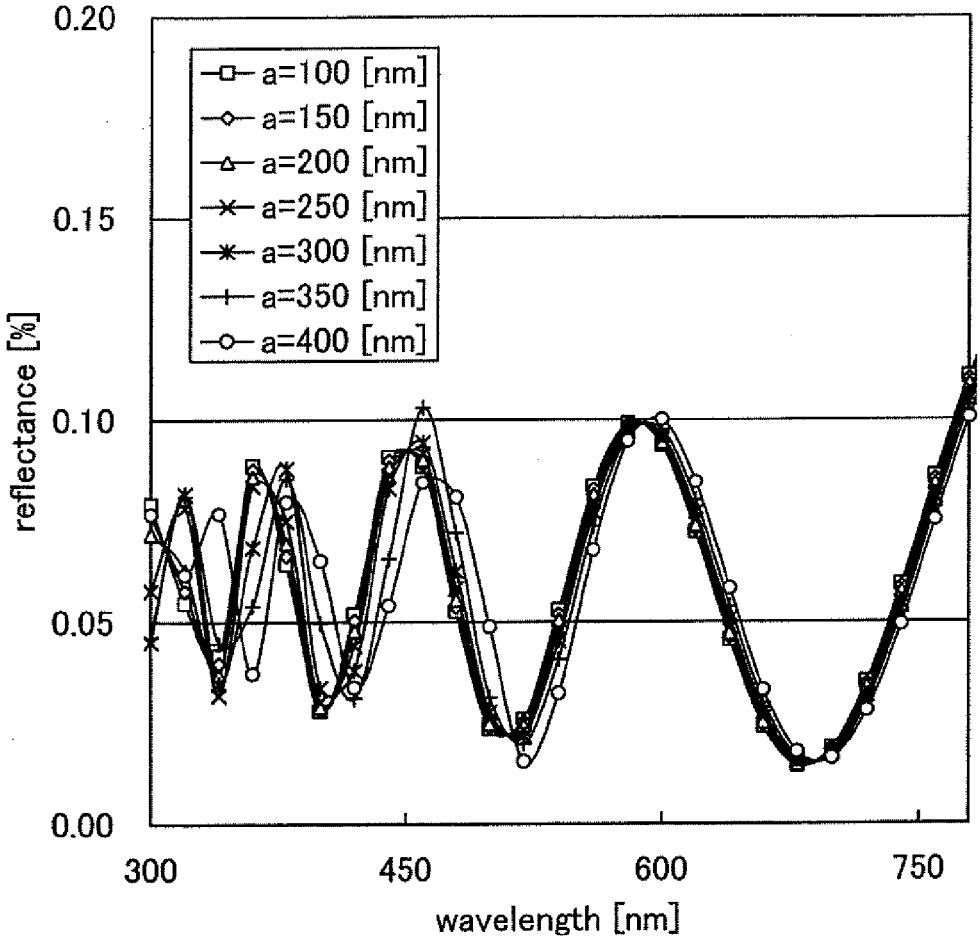
FIG. 29 is a graph showing experimental data of Embodiment Mode 1.

FIG. 29 shows a change in reflectance with respect to light of some wavelengths at the time when the height b of the hexagonal pyramidal projection is 800 nm, and the width a is changed to 100 nm (square data marker), 150 nm (diamond-shaped data marker), 200 nm (triangular data marker), 250 nm (x -shaped data marker), 300 nm (asterisk data marker), 350 nm (cross-shaped data marker), and 400 nm (circular data marker). It is confirmed that variation width with change of wavelengths decreases as the width a is reduced from 400 nm to 350 nm and 300 nm to converge on various graphs.

Figure 30:
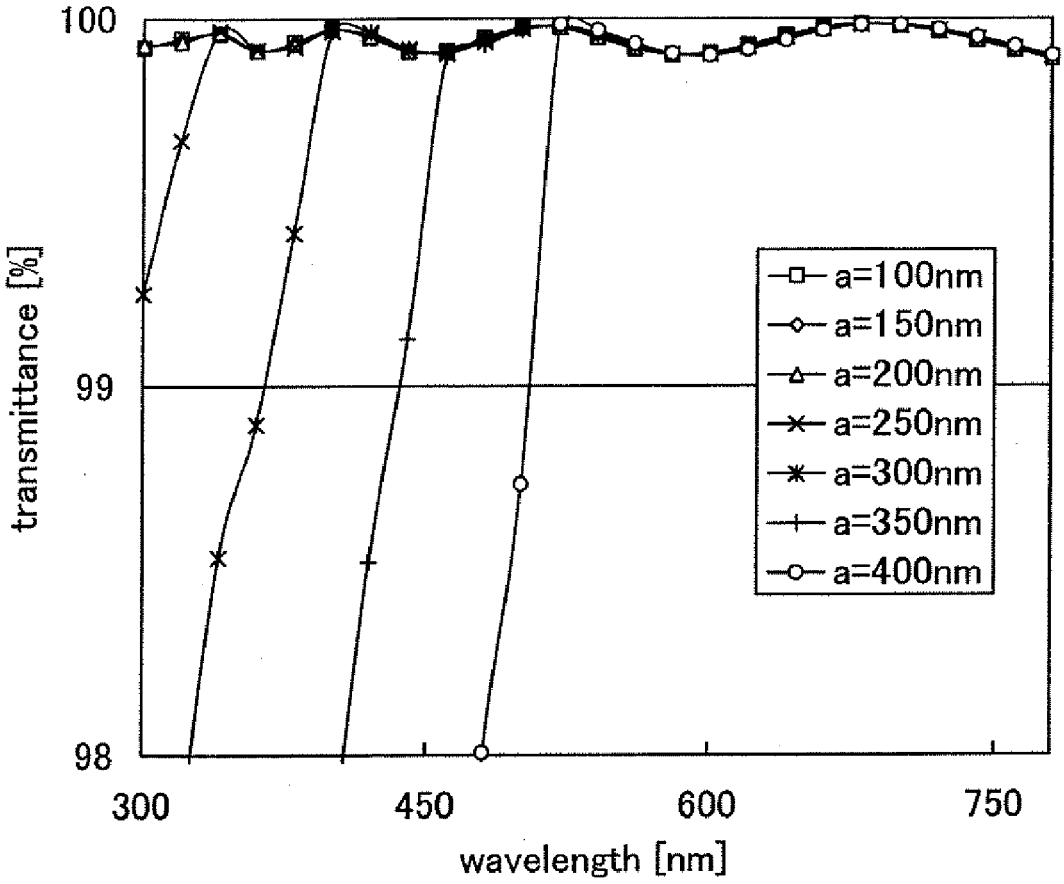
FIG. 30 is a graph showing experimental data of Embodiment Mode 1.

FIG. 30 shows results of optical calculations for transmittance of light which is transmitted from a base side of a hexagonal pyramidal projection to an apex thereof with respect to light of some wavelengths at the time when the height b of the hexagonal pyramidal projection is 800 nm, and the width a is changed among 100 nm (square data marker), 150 nm (diamond-shaped data marker), 200 nm (triangular data marker), 250 nm (x-shaped data marker), 300 nm (asterisk data marker), 350 nm (cross-shaped data marker), and 400 nm (circular data marker). As shown in FIG. 30, it is confirmed that the left end of the wavelength range in which transmittance is almost 100% is shifted to a low wavelength side as the width a is reduced from 400 nm to 350 nm when the height b is 800 nm, and almost 100% of light of all the wavelengths having a measurement wavelength range from 300 nm to 780 nm is transmitted when the width a is 300 nm or less, and light in the visible light region is sufficiently transmitted.

As described above, the distance between the apexes of the plurality of adjacent pyramidal projections is preferably 350 nm or less (more preferably, greater than or equal to 100 nm and less than or equal to 300 nm), and the height of each of the plurality of pyramidal projections is preferably 800 nm or more (more preferably, 1000 nm or more, and even more preferably, greater than or equal to 1600 nm and less than or equal to 2000 nm).

Figure 6A:
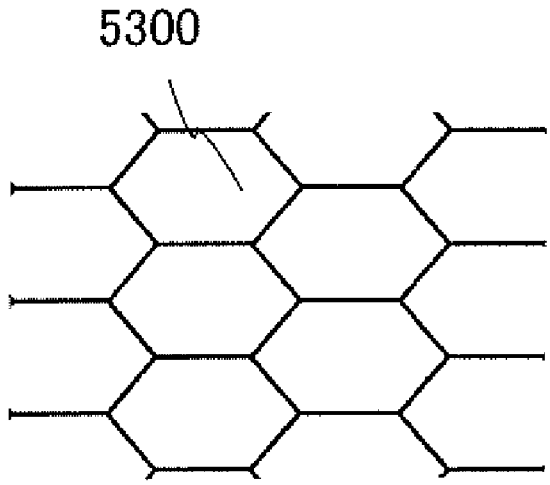
FIGS. 6A and 6B are top views showing a pyramidal projection which can be applied to the present invention.
Figure 6B:
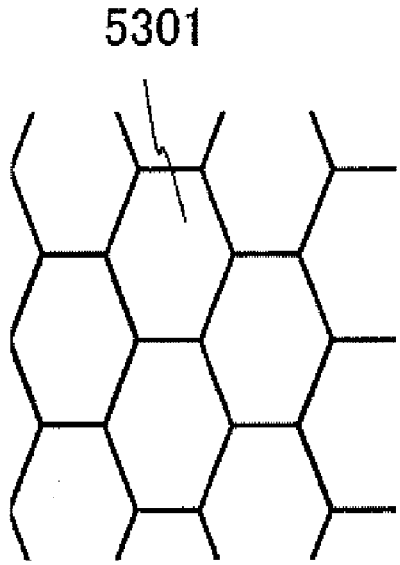

FIGS. 6A and 6B show another example of bases of the hexagonal pyramidal projections. The lengths of all six sides and magnitudes of the six interior angles are not necessarily equal to each other, as with a hexagonal pyramidal projection 5300 and a hexagonal pyramidal projection 5301 shown in FIGS. 6A and 6B. Pyramidal projections can be provided adjacent to each other to be packed together without any spaces, and incident light from external can be diffused in many directions even if the hexagonal pyramidal projection 5300 or the hexagonal pyramidal projection 5301 is used.

Figure 2A:
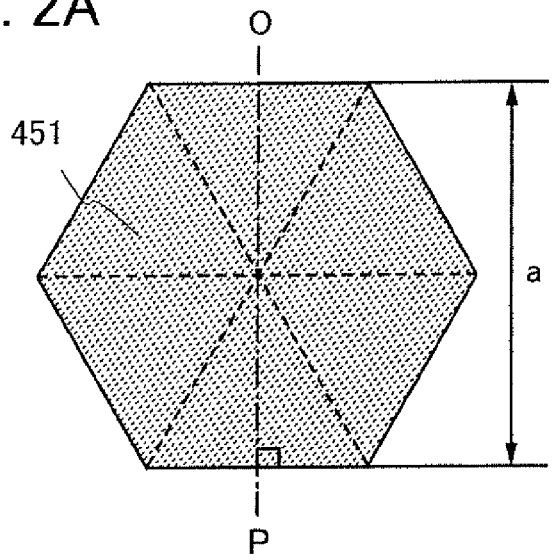
FIGS. 2A and 2B are schematic diagrams of the present invention.
Figure 2B:
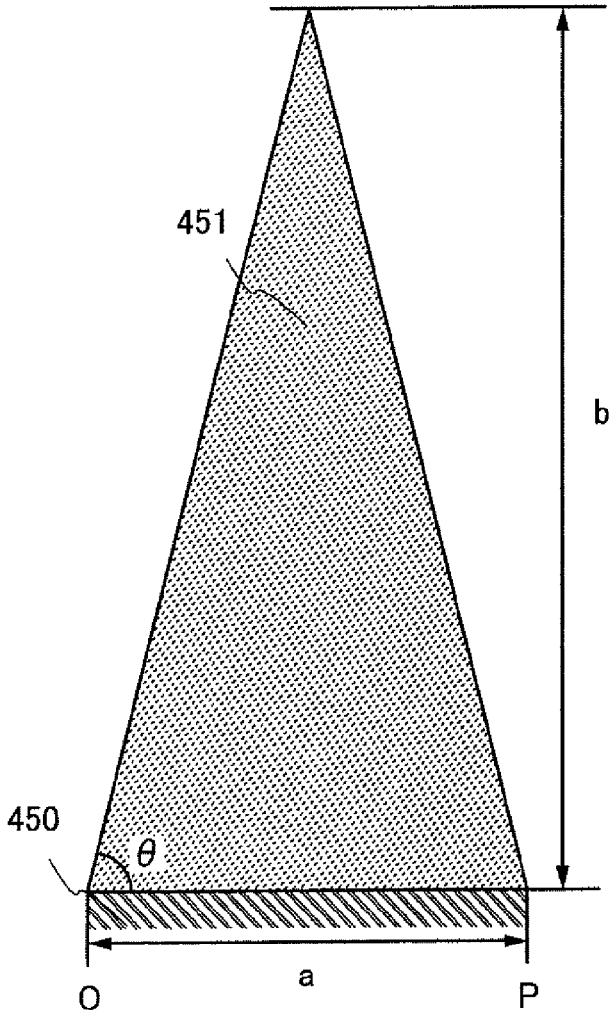

FIGS. 2A and 2B show enlarged views of the pyramidal projection having an anti-reflection structure in FIGS. 1A to 1D. FIG. 2A is a top view of the pyramidal projection, and FIG. 2B is a cross-sectional view taken along a line O-P from FIG. 2A. The line O-P is a line that is perpendicular to a side and passes through the center of the base of the pyramidal projection. In the cross section of the pyramidal projection as shown in FIG. 2B, a side of a pyramidal projection and the base make an angle (θ). In this specification, the length of the line that is perpendicular to a side of the base and passes through the center of the base of the pyramidal projection is referred to as the width a of the base of the hexagonal pyramidal projection. In addition, the length from the base to the apex of the hexagonal pyramidal projection is referred to as the height b of the hexagonal pyramidal projection.

In the pyramidal projection of this embodiment mode, it is preferable that the ratio of the height b to the width a of the base of the pyramidal projection be 5 or more to 1.

Figure 5A:
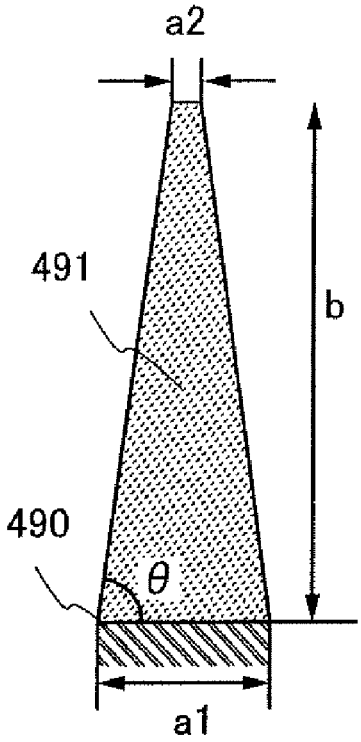
FIGS. 5A to 5C are cross-sectional views showing a pyramidal projection which can be applied to the present invention.
Figure 5B:
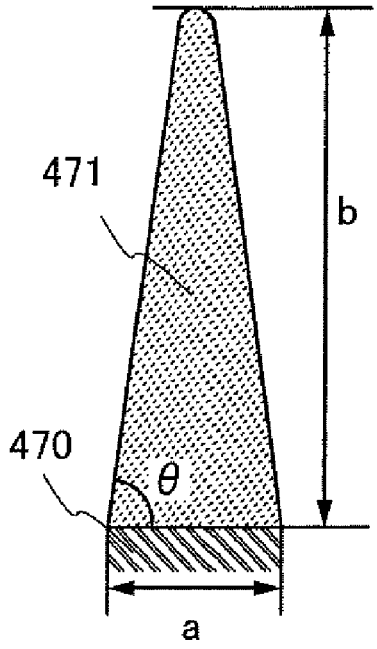
Figure 5C:
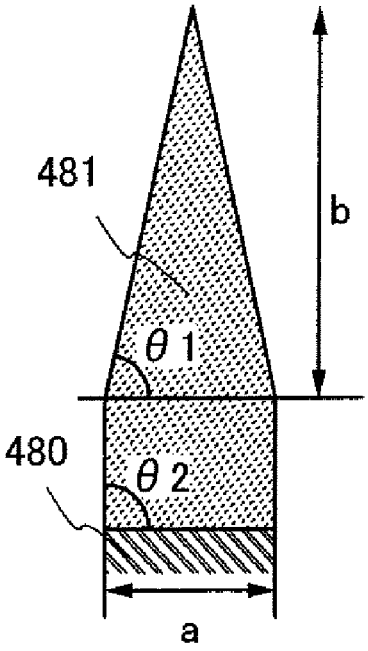

FIGS. 5A to 5C show examples of shapes of pyramidal projections. FIG. 5A shows a shape with an upper face (width a2) and a base (width a1), not a shape having a pointed top like a pyramidal projection. Therefore, a cross-sectional view on a plane perpendicular to the base is trapezoidal. In a pyramidal projection 491 provided on a surface of a substrate 490 that is to serve as a display screen, as shown in FIG. 5A, the distance between the base and the upper face is referred to as the height b in the present invention.

FIG. 5B shows an example in which a pyramidal projection 471 with a rounded top is provided on a surface of a substrate 470 that is to serve as a display screen. In this manner, a pyramidal projection may have a shape with a rounded top that has curvature. In this case, the height b of the pyramidal projection corresponds to the distance between the base and the highest point of the apical portion.

FIG. 5C shows an example in which a pyramidal projection 481, which is formed in such a way that side surfaces and a base of a hexagonal pyramidal projection make a plurality of angles $\theta_1$ and $\theta_2$ on a cross section, is provided on a surface of a substrate 480 that is to serve as a display screen. In this manner, a pyramidal projection may have a shape of a stack of a prismatic shape (the angle of a side surface of a pyramidal projection with respect to a base is set to be $\theta_2$) and a pyramidal projection (the angle of a side surface of a pyramidal projection with respect to a base is set to be $\theta_1$). In this case, $\theta_1$ and $\theta_2$, which are angles between side surfaces and bases of a pyramidal projection, are different from each other, and $0° < \theta_1 < \theta_2$ is satisfied. In the case of the pyramidal projection 481 shown in FIG. 5C, the height b of the pyramidal projection corresponds to the height of an oblique side of the pyramidal projection.

FIGS. 1A to 1D show a structure in which a plurality of pyramidal projections whose bases come into contact with each other are packed together; however, a structure in which a pyramidal projection is provided on a surface of an upper portion of a film (substrate) may be used. FIGS. 8A to 8D show an example in which the side surfaces of the pyramidal projection does not reach the display screen and a film 486 including a plurality of hexagonal pyramidal projections on a surface is provided (that is, an uninterrupted continuous film) in FIGS. 1A to 1D. The anti-reflection layer of the present invention may have a structure including pyramidal projections which are adjacent to each other to be packed together, and a pyramidal projection may be directly formed on a surface of a film (substrate) to be an uninterrupted continuous structure; for example, a surface of a film (substrate) may be processed and a pyramidal projection may be formed. For example, a shape having a pyramidal projection may be selectively formed by a printing method such as nanoimprinting. In addition, a pyramidal projection may be formed over a film (substrate) by another step. Furthermore, by using an adhesive, a hexagonal pyramidal projection may be attached to a surface of a film (substrate). In this way, the anti-reflection layer of the present invention can be formed by applying various shapes, each having a plurality of hexagonal pyramidal projections.

As a substrate (that is, a substrate that is to serve as a display screen) provided with a pyramidal projection, a glass substrate, a quartz substrate, or the like can be used. In addition, a flexible substrate may be used. The flexible substrate means a (flexible) substrate that is capable of being bent; for example, a plastic substrate formed of polyethylene terephthalate, polyethersulfone, polystyrene, polyethylene naphthalate, polycarbonate, polyimide, polyalylate, or the like; an elastomer which is a material that has a high molecular weight, or the like, with a property of being flexible at high temperature to be shaped similarly to plastic and a property of being an elastic body like a rubber at room temperature can be given. In addition, a film (formed of polypropylene, polyester, vinyl, polyvinyl fluoride, vinyl chloride, an inorganic vapor deposition film, or the like) can be used.

Figure 7A:
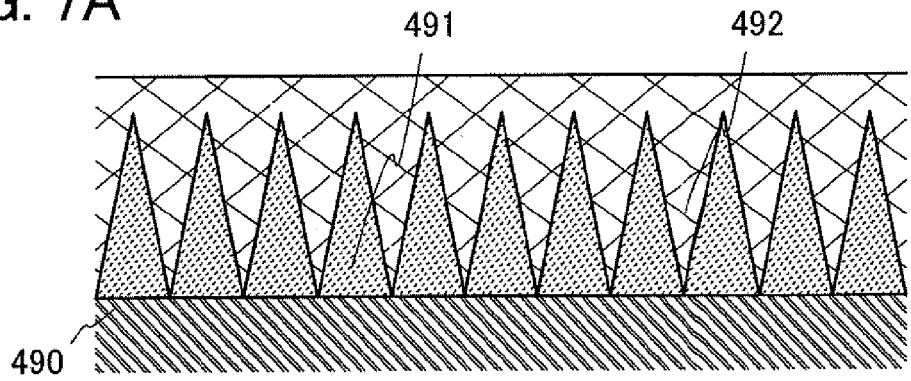
FIGS. 7A to 7D are cross-sectional views showing a pyramidal projection of the present invention.
Figure 7B:
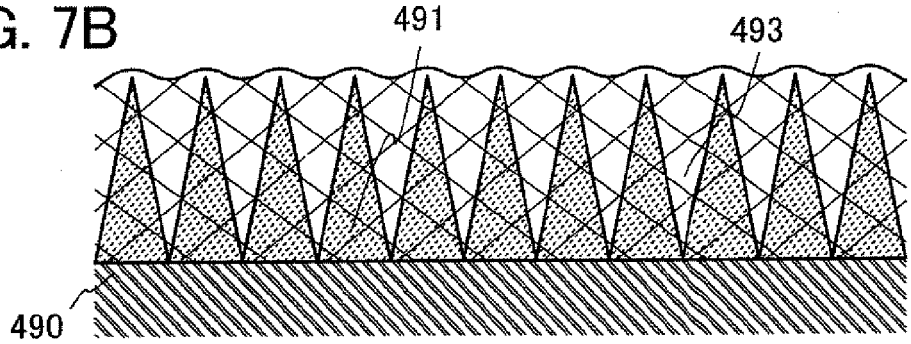

In the present invention, there are no limitations on the shape of the protective layer as long as it is provided in the space among the pyramidal projections. FIGS. 7A to 7D show examples of shapes of the protective layer. The thickness of the protective layer provided to fill the space among the pyramidal projections may be equivalent to the height of each pyramidal projection, or may be higher than the height of each pyramidal projection so as to cover each pyramidal projection as shown in FIGS. 7A and 7B. In this case, surface unevenness due to the pyramidal projections is reduced and planarized by the protective layer. FIG. 7A shows an example in which surface unevenness due to the pyramidal projections 491 provided on a surface of the substrate 490 that is to serve as a display screen is planarized by providing a protective layer 492 to completely cover the space among the pyramidal projections 491 and the tops thereof.

FIG. 7B shows an example in which a protective layer 493 is provided so as to completely cover the space among the pyramidal projections 491 provided on the surface of the substrate 490 that is to serve as a display screen and the tops thereof while the surface of the protective layer 493 is not completely planarized, but reflects the uneven shapes of the pyramidal projections 491 to some extent.

Figure 7C:
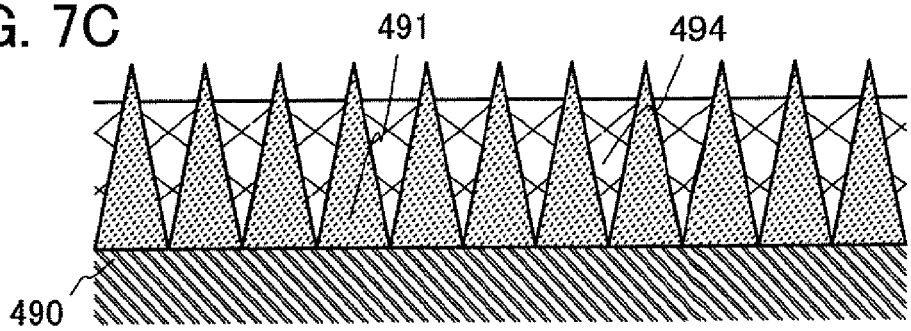

Alternatively, the thickness of the protective layer may be less than the height of the pyramidal projection, and in this case, a portion of the pyramidal projection closer to the side of the base is selectively covered and an apical portion of the pyramidal projection closer to the apex is exposed on the surface. FIG. 7C shows a structure in which a protective layer 494 selectively covers the pyramidal projections 491 provided on the surface of the substrate 490 that is to serve as a display screen so as to fill the space among the pyramidal projections 491, and an apical portion of each pyramidal projection 491 is exposed on the surface. When such a structure in which the pyramidal projections 491 are exposed on the surface is used, incident light from external directly enters the pyramidal projections 491 without passing through the protective layer. Accordingly, an anti-reflection function can be enhanced.

Figure 7D:
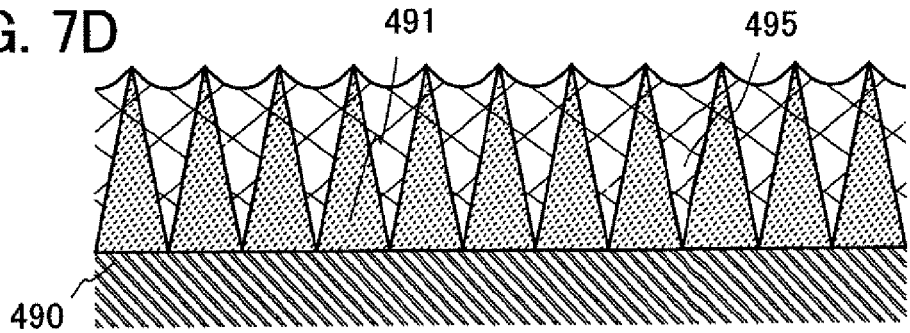
Figure 8A:
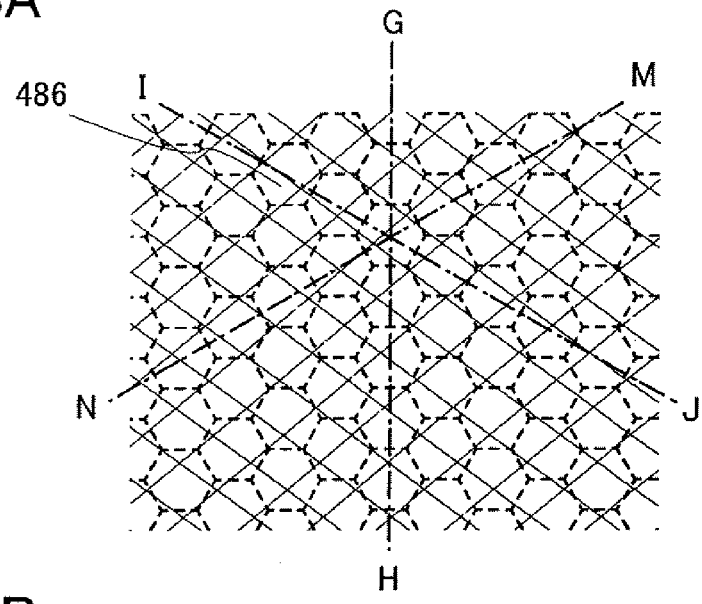
FIG. 8A is a top view showing an example of a pyramidal projection and a protective layer which can be applied to the present invention.
Figure 8B:
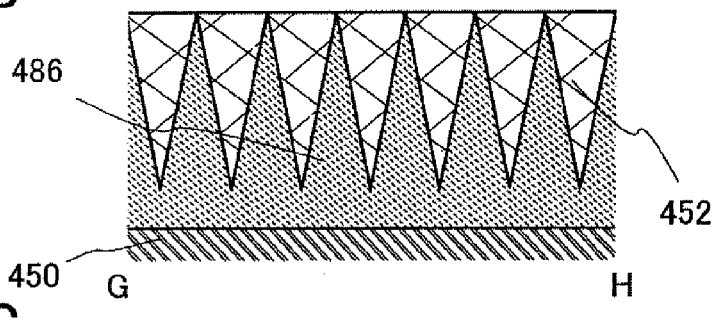
FIGS. 8B to 8D are cross-sectional views showing an example of a pyramidal projection and a protective layer which can be applied to the present invention.
Figure 8C:
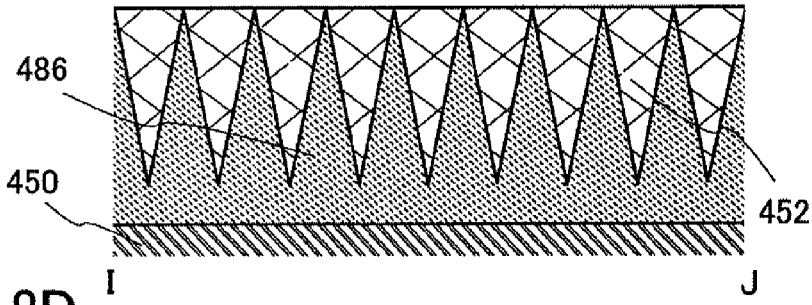
Figure 8D:
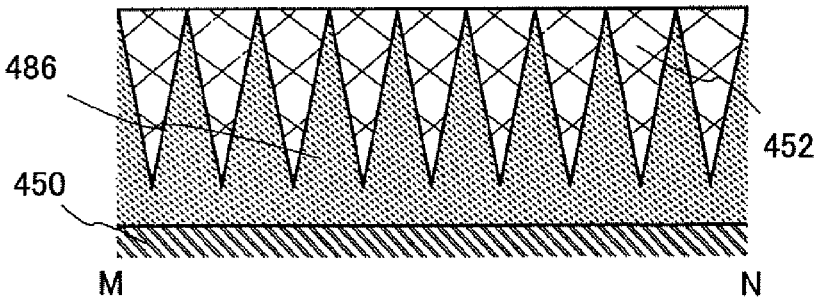

Depending on a formation method of the protective layer, a protective layer 495 formed in the space among the pyramidal projections 491 over the substrate 490 that is to serve as a display screen may have a shape in which the thickness is decreased as with a depression formed in the space among the pyramidal projections, as shown in FIG. 7D.

Any material is acceptable as long as the protective layer is formed using at least a material having a lower refractive index than a material used for the pyramidal projection having the anti-reflection function. Accordingly, the material used for the protective layer can be set as appropriate because it is determined relative to materials of a substrate forming a display screen of the PDP and the FED and the pyramidal projections formed over the substrate.

The pyramidal projection can further reduce reflection of incident light from external by its shape. However, when there is a foreign substance such as dirt or dust in the air in the space among the pyramidal projections, the foreign substance causes reflection of incident light from external, and accordingly, there is a case where a sufficient anti-reflection effect for incident light from external cannot be obtained. Since the protective layer is formed in the space among the pyramidal projections in the present invention, the entry of a contaminant, such as dust, into the space among the pyramidal projections can be prevented. Therefore, a decrease in anti-reflection function due to the entry of dust or the like can be prevented, and the physical strength of the anti-reflection film can be increased by filling the space among the pyramidal projections. Accordingly, reliability can be improved.

Since the protective layer filling the space among the pyramidal projections is formed using a material having a lower refractive index than a material used for the pyramidal projection, the difference between the refractive index of the air and that of the material used for the protective layer is lower than the difference between the refractive index of the air and that of the material used for the pyramidal projection, and reflection at interfaces can be further suppressed.

The pyramidal projection and the protective layer can be each formed not of a material with a uniform refractive index but of a material whose refractive index changes in the direction from an apical portion of the pyramidal projection to a portion closer to a substrate that is to serve as a display screen. For example, a structure in which a portion closer to the apical portion of each pyramidal projection is formed of a material having a refractive index equivalent to that of the air or the protective layer to reduce reflection of incident light from external which is incident on each pyramidal projection from the air on the surface of each pyramidal projection can be used. Meanwhile, the plurality of pyramidal projections may be formed of a material whose refractive index gets closer to that of the substrate that is to serve as the display screen so that reflection of light which propagates inside each pyramidal projection and is incident on the substrate is further reduced at the interface between the pyramidal projections and the substrate. When a glass substrate is used for the substrate, the refractive index of the air or the protective layer is lower than that of the glass substrate. Therefore, each pyramidal projection may have a structure which is formed in such a manner that a portion closer to an apical portion of each pyramidal projection is formed of a material having a lower refractive index and a portion closer to a base of each pyramidal projection is formed of a material having a higher refractive index, that is, the refractive index increases in the direction from the apical portion to the base of each pyramidal projection.

The composition of a material used for forming the pyramidal projection, such as silicon, nitrogen, fluorine, oxide, nitride, or fluoride, may be appropriately selected in accordance with a material of the substrate forming a surface of a display screen. The oxide may be silicon oxide, boric oxide, sodium oxide, magnesium oxide, aluminum oxide (alumina), potassium oxide, calcium oxide, diarsenic trioxide (arsenious oxide), strontium oxide, antimony oxide, barium oxide, indium tin oxide (ITO), zinc oxide, indium zinc oxide (IZO) in which indium oxide is mixed with zinc oxide, a conductive material in which indium oxide is mixed with silicon oxide, organic indium, organotin, indium oxide containing tungsten oxide, indium zinc oxide containing tungsten oxide, indium oxide containing titanium oxide, indium tin oxide containing titanium oxide, or the like. The nitride may be aluminum nitride, silicon nitride, or the like. The fluoride may be lithium fluoride, sodium fluoride, magnesium fluoride, calcium fluoride, lanthanum fluoride, or the like. The composition of a material used for forming the pyramidal projection may include one or more kinds of the above-mentioned silicon, nitrogen, fluorine, oxide, nitride, and fluoride. A mixing ratio thereof may be appropriately set in accordance with a ratio of components (a composition ratio) of each substrate.

The pyramidal projection can be formed by forming a thin film by a sputtering method, a vacuum evaporation method, a PVD (physical vapor deposition) method, or a CVD (chemical vapor deposition) method such as a low-pressure CVD (LPCVD) method or a plasma CVD method and then etching the thin film into a desired shape. Alternatively, a droplet discharge method by which a pattern can be formed selectively, a printing method by which a pattern can be transferred or drawn (a method for forming a pattern such as screen printing or offset printing), a coating method such as a spin coating method, a dipping method, a dispenser method, a brush application method, a spray method, a flow coating method, or the like can be employed. Still alternatively, an imprinting technique or a nanoimprinting technique by which a nanoscale three-dimensional structure can be formed by a transfer technology can be employed. Imprinting and nanoimprinting are techniques by which a minute three-dimensional structure can be formed without using a photolithography process.

The protective layer can be formed using a material for forming the pyramidal projection, or the like. As a material having a lower refractive index, silica, alumina, aerogel containing carbon, or the like can be used. A manufacturing method thereof is preferably a wet process, and a droplet discharge method by which a pattern can be formed selectively, a printing method by which a pattern can be transferred or drawn (a method for forming a pattern such as screen printing or offset printing), a coating method such as a spin coating method, a dipping method, a dispenser method, a brush application method, a spray method, a flow coating method, or the like can be employed.

Figure 4:
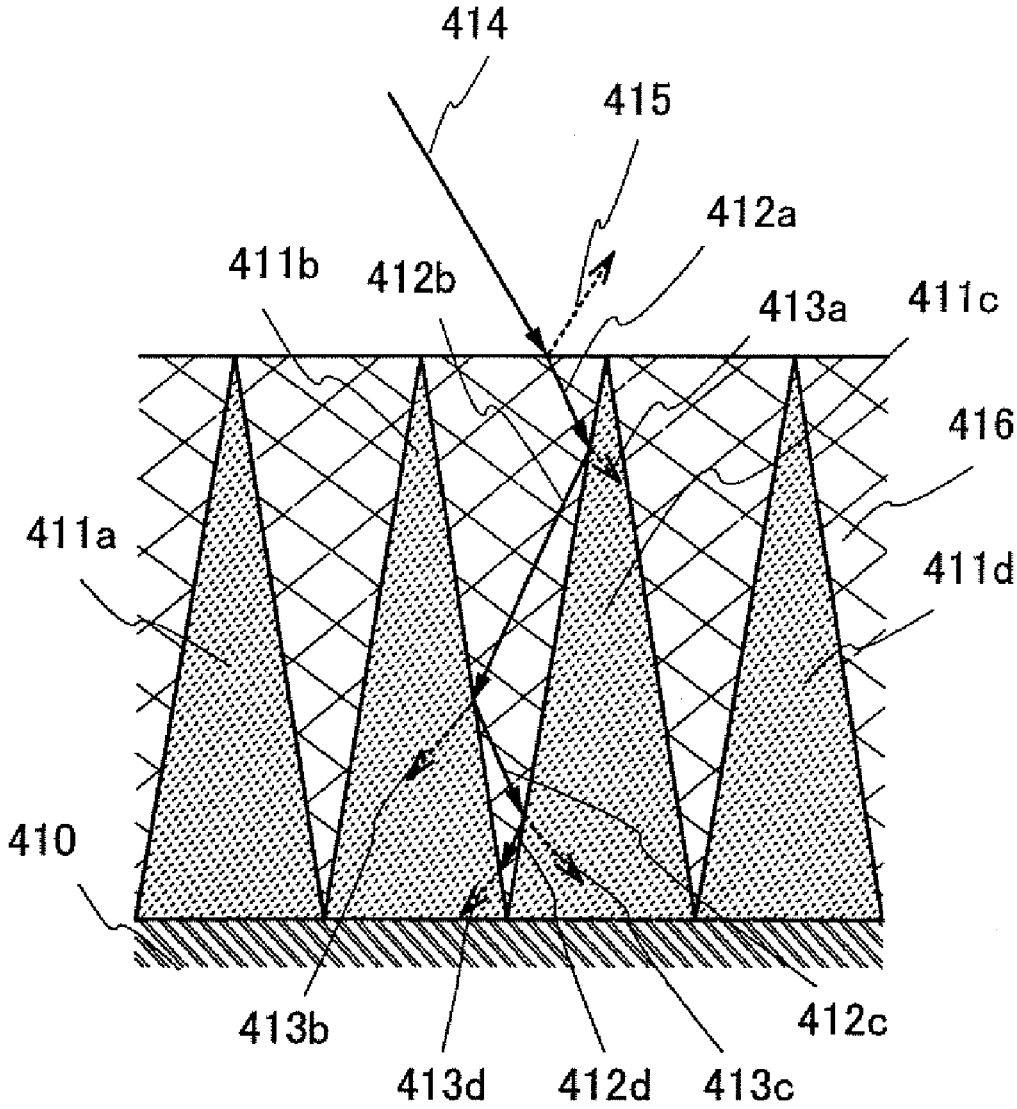
FIG. 4 is a schematic diagram of the present invention.

An anti-reflection function of the anti-reflection layer having a plurality of pyramidal projections of this embodiment mode is described with reference to FIG. 4. In FIG. 4, adjacent hexagonal pyramidal projections 411*a*, 411*b*, 411*c*, and 411*d* are provided to be packed together in a surface of a substrate 410 that is to serve as a display screen, and a protective layer 416 is formed thereover. One part of an incident light ray from external 414 is reflected as a reflected light ray 415 at the surface of protective layer 416, but a transmitted light ray 412*a* is incident on the pyramidal projection 411*c*. One part of the transmitted light ray 412*a* enters the pyramidal projection 411*c* as a transmitted light ray 413*a*, and the other part is reflected at the surface of the side of the pyramidal projection 411*c* as a reflected light ray 412*b*. The reflected light ray 412*b* is again incident on the pyramidal projection 411*b* which is adjacent to the pyramidal projection 411*c*. One part of the reflected light ray 412*b* enters the pyramidal projection 411*b* as a transmitted light ray 413*b*, and the other part is reflected at the surface of the side of the pyramidal projection 411*b* as a reflected light ray 412*c*. The reflected light ray 412*c* is again incident on the adjacent projection 411*c*. One part of the reflected light ray 412*c* enters the pyramidal projection 411*c* as a transmitted light ray 413*c*, and the other part is reflected at the surface of the side surface of the pyramidal projection 411*c* as a reflected light ray 412*d*. The reflected light ray 412*d* is again incident on the pyramidal projection 411*b* which is adjacent to the pyramidal projection 411*c*, and one part of the reflected light ray 412*d* enters the pyramidal projection 411*b* as a transmitted light ray 413*d*.

In this manner, the anti-reflection layer of this embodiment mode includes a plurality of pyramidal projections. Incident light from external is reflected not to a viewer side but to another adjacent pyramidal projection because the side surface of each pyramidal projection is not parallel to the display screen. Alternatively, incident light propagates between the pyramidal projections. One part of incident light enters an adjacent pyramidal projection, and the other part of the incident light is then incident on an adjacent pyramidal projection as reflected light. In this manner, incident light from external reflected at a side surface of a pyramidal projection is repeatedly incident on another adjacent pyramidal projection.

In other words, of the incident light from external that is incident on the anti-reflection layer, the number of times that the light is incident on the pyramidal projection of the anti-reflection layer is increased; therefore, the amount of incident light from external entering the anti-reflection layer is increased. Thus, the amount of incident light from external reflected to a viewer side can be reduced, and the cause of reduction in visibility such as reflection can be prevented.

Furthermore, since the protective layer is formed in the space among the pyramidal projections in this embodiment mode, the entry of a contaminant such as dust into the space among the pyramidal projections can be prevented. Therefore, a decrease in an anti-reflection function due to the entry of dust or the like can be prevented, and physical strength of the anti-reflection film (substrate) and the display device can be increased by filling the space among the pyramidal projections. Accordingly, reliability can be improved.

This embodiment mode can provide a PDP and an FED that each have high visibility and a high anti-reflection function that can further reduce reflection of incident light from external by providing the anti-reflection layer having a plurality of adjacent pyramidal projections to its surface and the protective layer in the space among the pyramidal projections. Accordingly, a PDP and an FED that each have higher quality and higher performance can be manufactured.

Embodiment Mode 2

In this embodiment mode, an example of a PDP for the purpose of having an anti-reflection function that can further reduce reflection of incident light from external and increasing visibility will be described. That is, a structure of a PDP including a pair of substrates, a pair of electrodes provided between the pair of substrates, a phosphor layer provided between the pair of electrodes, and an anti-reflection layer provided on an outer side of one substrate of the pair of substrates will be described in detail.

Figure 9:
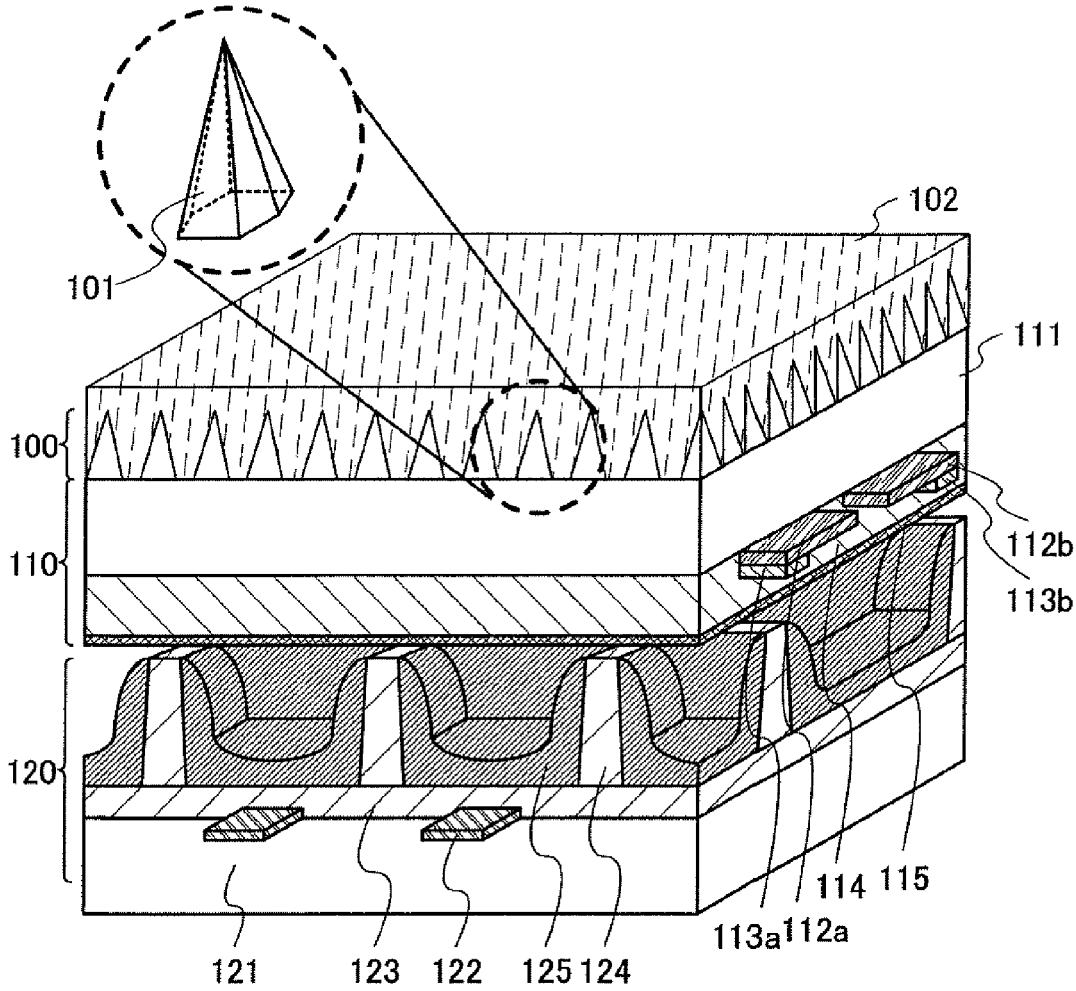
FIG. 9 is a perspective diagram showing a PDP of the present invention.

In this embodiment mode, a surface emission PDP of an alternating current discharge type (an AC type) is shown. As shown in FIG. 9, in a PDP, a front substrate 110 and a back substrate 120 are placed facing each other, and the periphery of the front substrate 110 and the back substrate 120 is sealed with a sealant (not shown). In addition, a region enclosed by the front substrate 110, the back substrate 120, and the sealant is filled in with a discharge gas.

Discharge cells of a display portion are arranged in matrix, and each discharge cell is provided at an intersection of a display electrode on the front substrate 110 and an address electrode on the back substrate 120.

The front substrate 110 is formed such that a display electrode extending in a first direction is formed on one surface of a first light-transmitting substrate 111. The display electrode is formed of light-transmitting conductive layers 112*a* and 112*b*, a scan electrode 113*a*, and a sustain electrode 113*b*. A light-transmitting insulating layer 114 which covers the first light-transmitting substrate 111, the light-transmitting conductive layers 112*a* and 112*b*, the scan electrode 113*a*, and the sustain electrode 113*b* is formed. Further, a protective layer 115 is formed on the light-transmitting insulating layer 114.

On the other surface of the first light-transmitting substrate 111, an anti-reflection layer 100 is formed. The anti-reflection layer 100 includes a pyramidal projection 101 and a protective layer 102. For the pyramidal projection 101 and the protective layer 102 included in the anti-reflection layer 100, the pyramidal projection and the protective layer described in Embodiment Mode 1 can be used, respectively.

The back substrate 120 is formed such that a data electrode 122 extending in a second direction intersecting with the first direction is formed over one surface of a second light-transmitting substrate 121. A dielectric layer 123 which covers the second light-transmitting substrate 121 and the data electrode 122 is formed. Partitions (ribs) 124 for dividing each discharge cell are formed over the dielectric layer 123. A phosphor layer 125 is formed in a region surrounded by the partitions (ribs) 124 and the dielectric layer 123.

A space surrounded by the phosphor layer 125 and the protective layer 115 is filled in with a discharge gas.

The first light-transmitting substrate 111 and the second light-transmitting substrate 121 can be formed using a glass substrate that has a high strain point or a soda lime glass substrate which can withstand a baking process performed at a temperature that exceeds 500° C., or the like.

The light-transmitting conductive layers 112*a* and 112*b* formed on the first light-transmitting substrate 111 preferably each have a light-transmitting property to transmit light emitted from a phosphor and are formed using ITO or tin oxide. In addition, the light-transmitting conductive layers 112*a* and 112*b* may be rectangular or T-shaped. The light-transmitting conductive layers 112*a* and 112*b* can be formed in such a way that a conductive layer is formed on the first light-transmitting substrate 111 by a sputtering method, a coating method, or the like and then selectively etched. Alternatively, the light-transmitting conductive layers 112*a* and 112*b* can be formed in such a way that a composition is selectively applied by a droplet discharge method, a printing method, or the like and then baked. Further alternatively, the Light-transmitting conductive layers 112*a* and 112*b* can be formed by a lift-off method.

The scan electrode 113*a* and the sustain electrode 113*b* are preferably formed of a conductive layer with a low resistance value and can be formed using chromium, copper, silver, aluminum, gold, or the like. In addition, a stack of copper, chromium, and copper or a stack of chromium, aluminum, and chromium can be used. As a method for forming the scan electrode 113*a* and the sustain electrode 113*b*, a similar method to that for forming the light-transmitting conductive layers 112*a* and 112*b* can be used, as appropriate.

The light-transmitting insulating layer 114 can be formed using glass with a low melting point containing lead or zinc. As a method for forming the light-transmitting insulating layer 114, a printing method, a coating method, a green sheet laminating method, or the like can be used.

The protective layer 115 is provided to protect from discharge plasma of the dielectric layer and to facilitate the emission of secondary electrons. Therefore, a material having a low ion sputtering rate, a high secondary electron emission coefficient, a low discharge starting voltage, and a high surface insulating property is preferably used. A typical example of such a material is magnesium oxide. As a method for forming the protective layer 115, an electron beam evaporation method, a sputtering method, an ion plating method, an evaporation method, or the like can be used.

Note that a color filter and a black matrix may be provided at an interface between the first light-transmitting substrate 111 and the light-transmitting conductive layers 112*a* and 112*b*, at an interface between the light-transmitting conductive layers 112*a* and 112*b* and the light-transmitting insulating layer 114, in the light-transmitting insulating layer 114, at an interface between the light-transmitting insulating layer 114 and the protective layer 115, or the like. Providing the color filter and the black matrix makes it possible to improve contrast between light and dark and the color purity of emission color of a phosphor can be improved. A colored layer corresponding to an emission spectrum of a light-emission cell is provided for the color filter.

As the material of the color filter, there are a material in which an inorganic pigment is dispersed throughout light-transmitting glass having a low melting point, colored glass of which a colored component is a metal or metal oxide, and the like. For the inorganic pigment, an iron oxide-based material (red), a chromium-based material (green), a vanadium-chromium-based material (green), a cobalt aluminate-based material (blue), or a vanadium-zirconium-based material (blue) can be used. Moreover, for the inorganic pigment of the black matrix, an iron-cobalt-chromium-based material can be used. In addition to the inorganic pigment, colorants can be mixed as appropriate to be used as a desired color tone of RGB or a desired black matrix.

The data electrode 122 can be formed in a manner similar to that of the scan electrode 113*a* and the sustain electrode 113*b*.

The dielectric layer 123 is preferably white having a high reflectance so as to efficiently extract light emitted from a phosphor to the front substrate side. The dielectric layer 123 can be formed using glass with a low melting point containing lead, alumina, titania, or the like. As a method for forming the dielectric layer 123, a similar method to that for forming the light-transmitting insulating layer 114 can be used, as appropriate.

The partitions (ribs) 124 are formed using glass with a low melting point containing lead and a ceramic. The partitions (ribs) can prevent color mixture of emitted light between adjacent discharge cells and improve color purity when the partitions (ribs) are formed in a criss-cross shape. As a method for forming the partitions (ribs) 124, a screen printing method, a sandblast method, an additive method, a photosensitive paste method, a pressure forming method, or the like can be used. Although the partitions (ribs) 124 are formed in a crisscross shape in FIG. 9, a polygonal or circular shape may be used instead.

The phosphor layer 125 can be formed using various fluorescent materials which can emit light by ultraviolet irradiation. For example, there are $BaMgAl_{14}O_{23}$:Eu as a fluorescent material for blue, $(Y,Ga)BO_3$:Eu as a fluorescent material for red, and $Zn_2SiO_4$:Mn as a fluorescent material for green; however, other fluorescent materials can be used, as appropriate. The phosphor layer 125 can be formed by a printing method, a dispenser method, an optical adhesive method, a phosphor dry film method by which a dry film resist in which phosphor powder is dispersed is laminated, or the like.

For a discharge gas, a mixed gas of neon and argon; a mixed gas of helium, neon and xenon; a mixed gas of helium, xenon, and krypton; or the like can be used.

Next, a method for forming a PDP is shown hereinafter.

In the periphery of the back substrate 120, glass for sealing is printed by a printing method and then pre-baked. Next, the front substrate 110 and the back substrate 120 are aligned, temporally fixed to each other, and then heated. As a result, the glass for sealing is melted and cooled, whereby the front substrate 110 and the back substrate 120 are attached together so that a panel is made. Next, the inside of the panel is drawn down to vacuum while the panel is being heated. Next, after a discharge gas is introduced inside the panel from a vent pipe provided in the back substrate 120, an open end of the vent pipe is blocked and the inside of the panel is sealed airtight by heating the vent pipe provided in the back substrate 120. Then, a cell of the panel is discharged, and aging during which discharging is continued until luminescence properties and electric discharge characteristics become stable is performed. Thus, the panel can be completed.

Figure 10A:
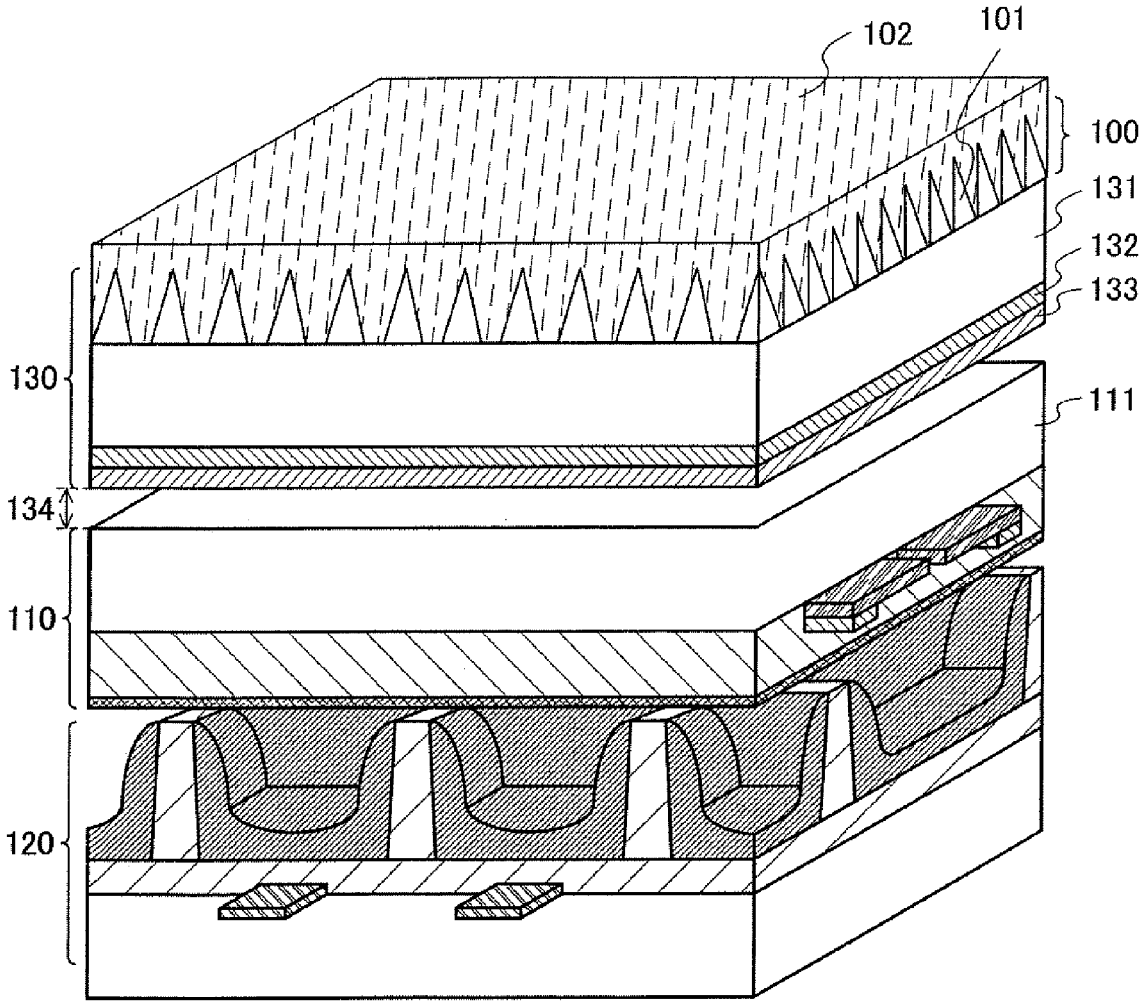
FIGS. 10A and 10B are perspective diagrams showing a PDP of the present invention.

As a PDP of this embodiment mode, as shown in FIG. 10A, an optical filter 130, in which an electromagnetic wave shield layer 133 and a near-infrared ray shielding layer 132 are formed on one surface of a light-transmitting substrate 131 and the anti-reflection layer 100 as described in Embodiment Mode 1 is formed on the other surface of the light-transmitting substrate 131, may be formed with the front substrate 110 and the back substrate 120 which are sealed. Note that in FIG. 10A, a mode is shown in which the anti-reflection layer 100 is not formed on a surface of the first light-transmitting substrate 111 of the front substrate 110; however, an anti-reflection layer as described in Embodiment Mode 1 may also be provided on the surface of the first light-transmitting substrate 111 of the front substrate 110. With such a structure, reflectance of incident light from external can be reduced further.

When plasma is generated inside of the PDP, electromagnetic waves, infrared rays, and the like are released outside of the PDP. Electromagnetic waves are harmful to human bodies. In addition, infrared rays cause malfunction of a remote controlled For this reason, the optical filter 130 is preferably used to shield from electromagnetic waves and infrared rays.

The anti-reflection layer 100 may be formed over the light-transmitting substrate 131 by the manufacturing method described in Embodiment Mode 1. Alternatively, the surface of the light-transmitting substrate 131 may be an anti-reflection layer. Further alternatively, the anti-reflection layer 100 may be attached to the light-transmitting substrate 131 using a UV curing adhesive or the like.

As a typical example of the electromagnetic wave shield layer 133, there are metal mesh, metal fiber mesh, mesh in which an organic resin fiber is coated with a metal layer, and the like. The metal mesh and the metal fiber mesh are formed of gold, silver, platinum, palladium, copper, titanium, chromium, molybdenum, nickel, zirconium, or the like. The metal mesh can be formed by a plating method, an electroless plating method, or the like after a resist mask is formed over the light-transmitting substrate 131. Alternatively, the metal mesh can be formed in such a way that a conductive layer is formed over the light-transmitting substrate 131, and then, the conductive layer is selectively etched by using a resist mask formed by a photolithography process. In addition, the metal mesh can be formed by using a printing method, a droplet discharge method, or the like, as appropriate. Note that the surface of each of the metal mesh, the metal fiber mesh, and the metal layer formed on a surface of the resin fiber is preferably processed to be black in order to reduce reflectance of visible light.

An organic resin fiber whose surface is covered with a metal layer can be formed of polyester, nylon, vinylidene chloride, aramid, vinylon, cellulose, or the like. In addition, the metal layer on the surface of the organic resin fiber can be formed using any one of the materials used for the metal mesh.

For the electromagnetic wave shield layer 133, a light-transmitting conductive layer having a surface resistance of 10Ω/or less, preferably, 4Ω/or less, and more preferably, 2.5Ω/or less can be used. For the light-transmitting conductive layer, a light-transmitting conductive layer formed of ITO, tin oxide, zinc oxide, or the like can be used. The thickness of the light-transmitting conductive layer is preferably greater than or equal to 100 nm and less than or equal to 5 μm considering surface resistance and a light-transmitting property.

In addition, as the electromagnetic wave shield layer 133, a light-transmitting conductive film can be used. As the light-transmitting conductive film, a plastic film throughout which conductive particles are dispersed can be used. For the conductive particles, there are particles of carbon, gold, silver, platinum, palladium, copper, titanium, chromium, molybdenum, nickel, zirconium, and the like.

Figure 10B:
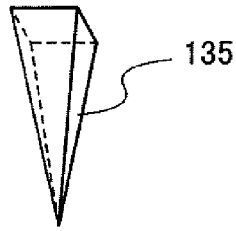

Further, as the electromagnetic wave shield layer 133, a plurality of electromagnetic wave absorbers 135 having a pyramidal shape as shown in FIG. 10B may be provided. As the electromagnetic wave absorber, a polygonal pyramid such as a triangular pyramid, a quadrangular pyramid, a pentagonal pyramid, or a hexagonal pyramid; a circular cone; or the like can be used. The electromagnetic wave absorber can be formed using a material similar to that of the light-transmitting conductive film. Further, the electromagnetic wave absorber may be formed such that a light-transmitting conductive layer formed of ITO or the like is processed into a circular cone or a polygonal pyramid. Furthermore, the electromagnetic wave absorber may be formed in such a way that a circular cone or a polygonal pyramid is formed using a material similar to that of the light-transmitting conductive film and then a light-transmitting conductive layer is formed on the surface of the circular cone or polygonal pyramid. Note that an apical angle of the electromagnetic wave absorber faces toward the first light-transmitting substrate 111 side, whereby absorption of electromagnetic waves can be increased.

Note that the electromagnetic wave shield layer 133 may be attached to the near-infrared ray shielding layer 132 using an adhesive such as an acrylic-based adhesive, a silicone-based adhesive, or a urethane-based adhesive.

Note that an end portion of the electromagnetic wave shield layer 133 is grounded to an earth ground terminal.

The near-infrared ray shielding layer 132 is a layer in which one or more kinds of dyes having a maximum absorption wavelength in a wavelength range of 800 nm to 1000 nm is dissolved into an organic resin. As the dyes, there are a cyanine-based compound, a phthalocyanine-based compound, a naphthalocyanine-based compound, a naphthoquinone-based compound, an anthraquinone-based compound, a dithiol-based complex, and the like.

As an organic resin which can be used for the near-infrared ray shielding layer 132, a polyester resin, a polyurethane resin, an acrylic resin, or the like can be used, as appropriate. In addition, a solvent can be used, as appropriate, to dissolve the dye.

As the near-infrared ray shielding layer 132, a light-transmitting conductive layer formed of a copper-based material, a phthalocyanine-based compound, zinc oxide, silver, ITO, or the like; or a nickel complex layer may be formed on the surface of the light-transmitting substrate 131. Note that, in the case of forming the near-infrared ray shielding layer 132 with the material, the near-infrared ray shielding layer 132 has a light-transmitting property and is formed at a thickness at which near-infrared rays are blocked.

As a method for forming the near-infrared ray shielding layer 132, a composition can be applied by a printing method, a coating method, or the like and cured by heat or light irradiation.

For the light-transmitting substrate 131, a glass substrate, a quartz substrate, or the like can be used. In addition, a flexible substrate may be used as well. A flexible substrate is a (flexible) substrate that is capable of being bent, and for example, a plastic substrate and the like formed of polyethylene terephthalate, polyethersulfone, polystyrene, polyethylene naphthalate, polycarbonate, polyimide, polyarylate, and the like are given. Alternatively, a film (formed of polypropylene, polyester, vinyl, polyvinyl fluoride, vinyl chloride, polyamide, an inorganic vapor deposition film, or the like) can be used.

Figure 11:
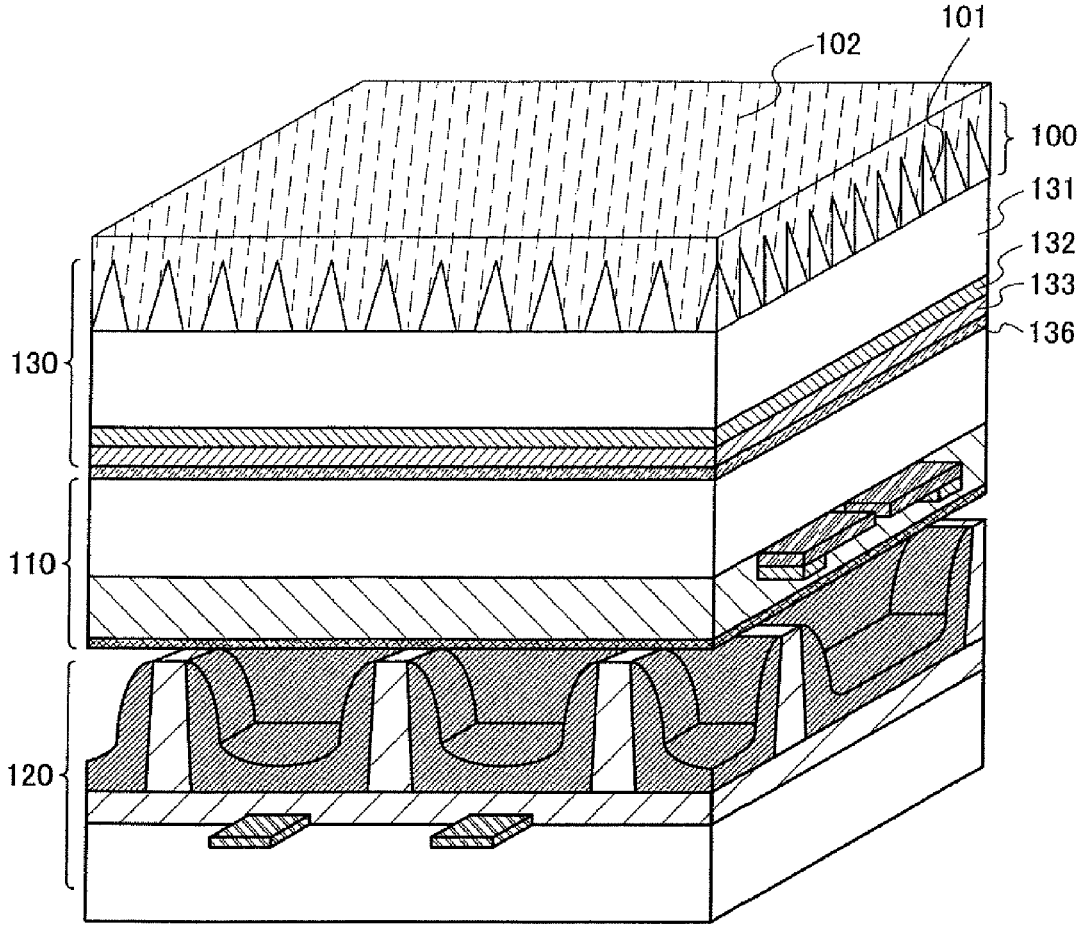
FIG. 11 is a perspective diagram showing a PDP of the present invention.

Note that in FIG. 10A, the front substrate 110 and the optical filter 130 are provided with a space 134 interposed therebetween; however, as shown in FIG. 11, the optical filter 130 and the front substrate 110 may be attached to each other by using an adhesive 136. For the adhesive 136, an adhesive having a light-transmitting property can be used, as appropriate, and typically, there are an acrylic-based adhesive, a silicone-based adhesive, a urethane-based adhesive, and the like.

In particular, when a plastic is used for the light-transmitting substrate 131 and the optical filter 130 is provided on the surface of the front substrate 110 by use of the adhesive 136, reductions in thickness and weight of a plasma display can be achieved.

Note that the electromagnetic wave shield layer 133 and the near-infrared ray shielding layer 132 are formed using different layers here; however, the electromagnetic wave shield layer 133 and the near-infrared ray shielding layer 132 may be formed of one functional layer that has an electromagnetic wave shield function and a near-infrared ray shielding function instead. In this way, the thickness of the optical filter 130 can be reduced, and reductions in weight and thickness of the PDP can be achieved.

Figure 12:
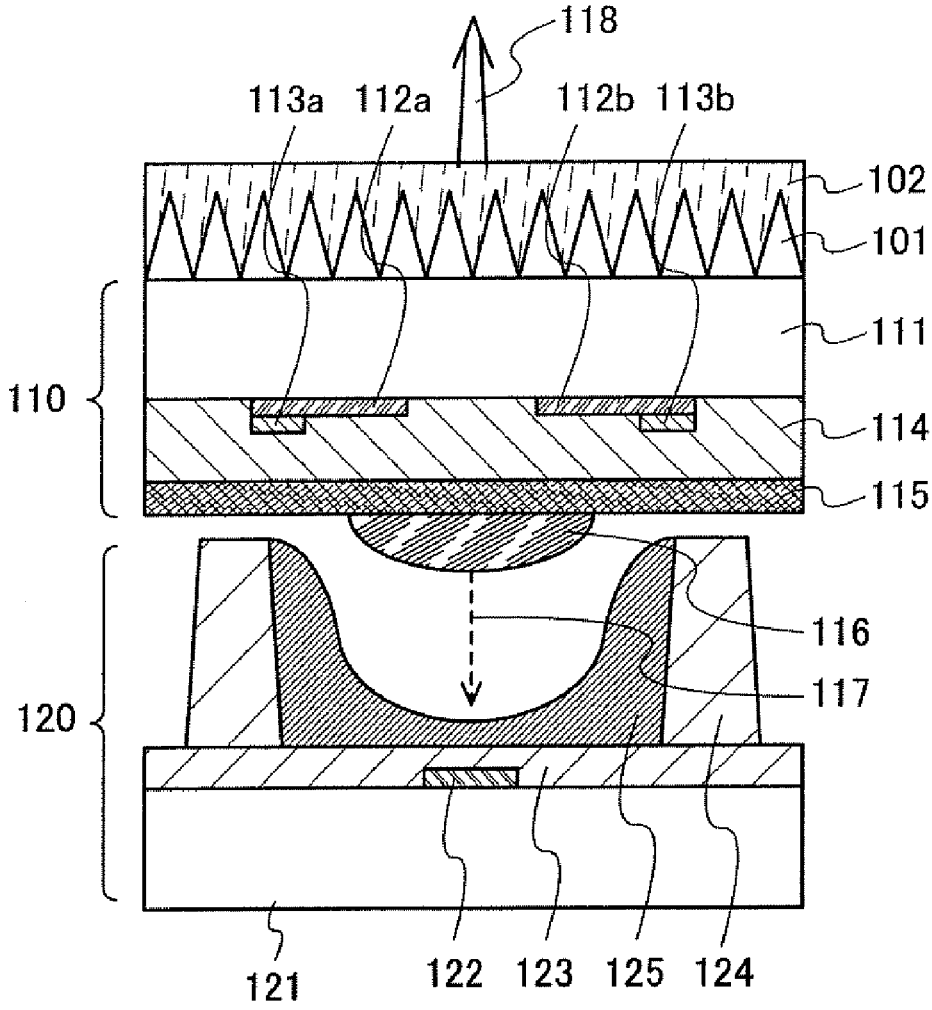
FIG. 12 is a cross-sectional view showing a PDP of the present invention.
Figure 13:
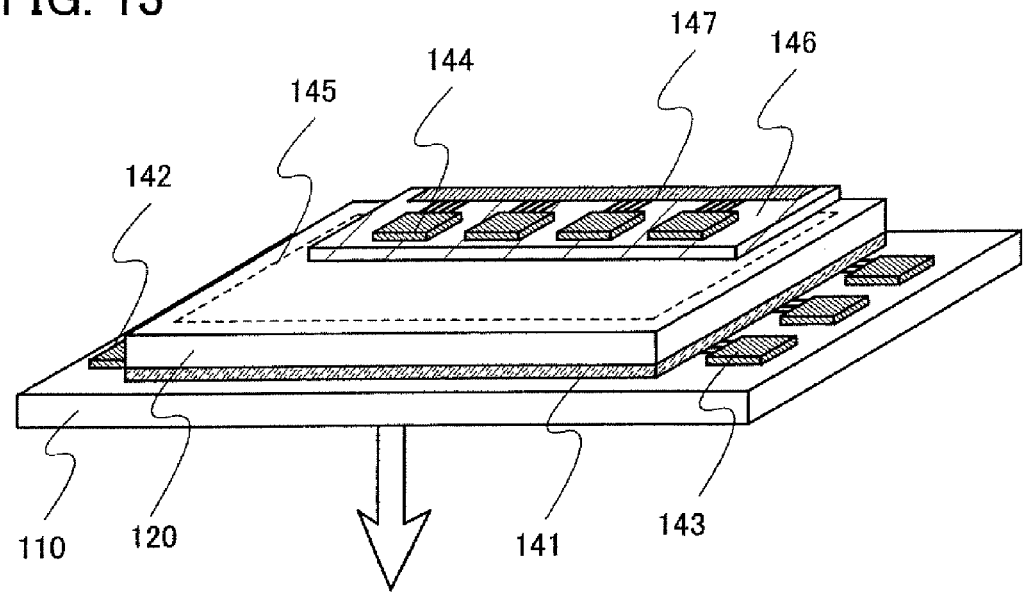
FIG. 13 is a perspective diagram showing a PDP module of the present invention.
Figure 14:
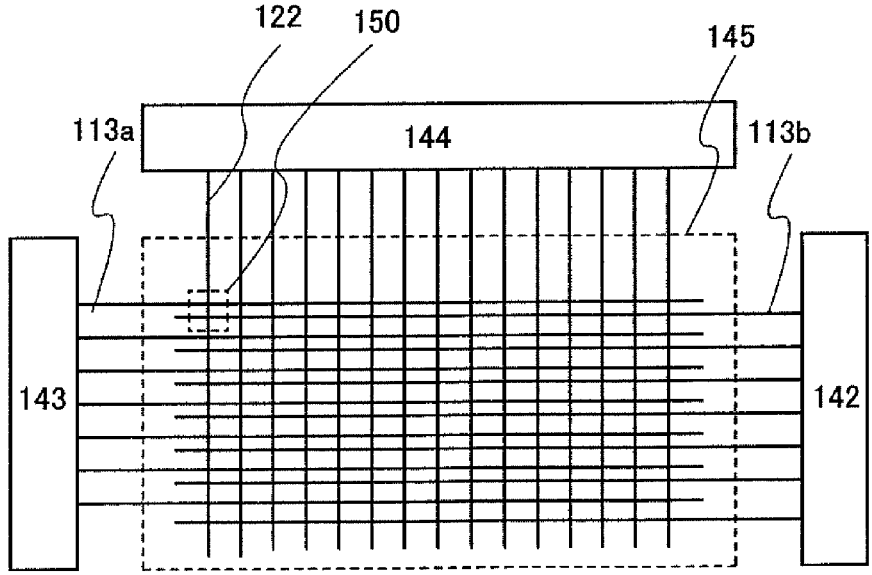
FIG. 14 is a diagram showing of a PDP the present invention.

Next, a PDP module and a driving method thereof are described with reference to FIG. 12, FIG. 13, and FIG. 14. FIG. 12 is a cross-sectional view of a discharge cell. FIG. 13 is a perspective diagram of a PDP module. FIG. 14 is a schematic diagram of a PDP module.

As shown in FIG. 13, in the PDP module, the periphery of the front substrate 110 and the back substrate 120 is sealed with glass 141 for sealing. A scan electrode driver circuit 142 that drives a scan electrode and a sustain electrode driver circuit 143 that drives a sustain electrode are provided over the first light-transmitting substrate which is part of the front substrate 110. The scan electrode driver circuit 142 is connected to the scan electrode, and the sustain electrode driver circuit 143 is connected to the sustain electrode.

A data electrode driver circuit 144 that drives a data electrode is provided over the second light-transmitting substrate which is part of the back substrate 120 and is connected to the data electrode. Here, the data electrode driver circuit 144 is provided over a wiring board 146 and connected to the data electrode through an FPC 147. Although not shown, a control circuit which controls the scan electrode driver circuit 142, the sustain electrode driver circuit 143, and the data electrode driver circuit 144 is provided over the first light-transmitting substrate 111 or the second light-transmitting substrate 121.

As shown in FIG. 14, a discharge cell 150 of a display portion 145 is selected by a control portion based on inputted image data, and a pulse voltage of a voltage equal to a discharge starting voltage or more is applied to the scan electrode 113*a* and the data electrode 122 of the discharge cell 150 and discharge is performed between the electrodes. A wall charge is accumulated on the surface of the protective layer due to the electric discharge, and a wall voltage is generated. Then, by applying a pulse voltage between display electrodes (between the scan electrode 113*a* and the sustain electrode 113*b*) used to maintain an electric discharge, plasma 116 is generated on the front substrate 110 side as shown in FIG. 12 to maintain an electric discharge. In addition, when a surface of the phosphor layer 125 of the back substrate is irradiated with ultraviolet rays 117 generated from a discharge gas in the plasma, the phosphor layer 125 is excited to cause a phosphor to emit light, and the light is emitted to the front substrate side as emitted light 118.

Note that, because there is not need for the sustain electrode 113*b* to scan the inside of the display portion 145, the sustain electrode 113*b* can serve as a common electrode. In addition, with the sustain electrode serving as a common electrode, the number of driver ICs can be reduced.

As a PDP in this embodiment mode, an AC type reflection type surface emission PDP is described; however, the present invention is not limited thereto. In an AC discharge type transmissive emission PDP, the anti-reflection layer 100 can be provided. Further, in a direct current (DC) discharge type PDP, the anti-reflection layer 100 can be provided.

The PDP described in this embodiment mode includes the anti-reflection layer on its surface. The anti-reflection layer includes a plurality of pyramidal projections, and incident light from external is reflected not to a viewer side but to another adjacent pyramidal projection because the side of each pyramidal projection is not perpendicular to the direction of incidence of incident light from external. Alternatively, reflected light of incident light from external propagates between the adjacent pyramidal projections. One part of incident light enters an adjacent pyramidal projection, and the other part of the incident light is then incident on an adjacent pyramidal projection as reflected light. In this manner, incident light from external reflected at the surface of the side of a pyramidal projection is repeatedly incident on adjacent pyramidal projections.

In other words, the number of times which is incident on the pyramidal projections of the PDP of incidence of incident light from external is increased; therefore, the amount of incident light from external entering the pyramidal projection is increased. Thus, the amount of incident light from external reflected to a viewer side is reduced, and a cause of the reduction in visibility such as reflection can be prevented.

In a display screen, since incident light from external is reflected to a viewer side when there is a planar portion (a surface parallel to the display screen) with respect to incident light from external, a smaller planar region has a high antireflection function. In addition, it is preferable that a pyramidal projection with a plurality of side surfaces of a pyramidal projection which face in different directions with respect to a base be formed on a surface of a substrate that is to serve as a display screen for diffusing incident light from external.

The hexagonal pyramidal projection in this embodiment mode can have a close-packed structure without any spaces and has an optimal shape from among such shapes, having the largest number of sides of a pyramidal projection and a high anti-reflection function that can diffuse light in many directions efficiently.

The distance between apexes of the plurality of adjacent pyramidal projections is preferably 350 nm or less, and the height of the plurality of pyramidal projections is preferably 800 nm or higher. In addition, when the filling factor of a base of the plurality of pyramidal projections per unit area over the surface of the substrate that is to serve as a display screen is 80% or more, preferably, 90% or more, since the ratio of incident light from external which is incident on a planar portion is reduced, light can be prevented from being reflected to a viewer side, which is preferable.

The pyramidal projection can be formed not of a material with a uniform refractive index but of a material whose refractive index changes from an apical portion of the pyramidal projection to a portion closer to a substrate that is to serve as a display screen. For example, in each of the plurality of pyramidal projections, a structure is used in which a portion closer to the apical portion of each pyramidal projection can be formed of a material having a refractive index equivalent to that of the air or the protective layer to further reduce reflection of incident light from external which is incident on the surface of each pyramidal projection from the air. Meanwhile, the plurality of pyramidal projections is formed of a material having a refractive index equivalent to that of the substrate as a portion closer to the substrate that is to serve as the display screen so that reflection of light which propagates inside each pyramidal projection and is incident on the substrate is reduced at the interface between each pyramidal projection and the substrate. When a glass substrate is used for the substrate, the refractive index of the air or the protective layer is lower than that of the glass substrate. Therefore, each pyramidal projection may have a structure which is formed in such a manner that a portion closer to an apical portion of each pyramidal projection is formed of a material having a lower refractive index and a portion closer to a base of each pyramidal projection is formed of a material having a higher refractive index, that is, the refractive index increases from the apical portion to the base of each pyramidal projection.

Furthermore, since the protective layer is formed in the space among the pyramidal projections in the present invention, the entry of a contaminant, such as dust, into the space among the pyramidal projections can be prevented. Therefore, a decrease in anti-reflection function due to the entry of dust or the like can be prevented, and the physical strength of the PDP can be increased by filling the space among the pyramidal projections. Accordingly, reliability can be improved.

The PDP described in this embodiment mode includes a high anti-reflection function that can further reduce reflection of incident light from external by providing the anti-reflection layer having a plurality of adjacent pyramidal projections to its surface and the protective layer in the space among the pyramidal projections. Therefore, a PDP having high visibility can be provided. Accordingly, a PDP having higher quality and higher performance can be manufactured.

Embodiment Mode 3

In this embodiment mode, an FED for the purpose of having an anti-reflection function that can further reduce reflection of incident light from external and increasing visibility will be described. That is, a structure of an FED including a pair of substrates, a field emission element provided on one substrate of the pair of substrates, an electrode provided on the other substrate of the pair of substrates, a phosphor layer which comes into contact with the electrode, and an anti-reflection layer provided on an outer side of the other substrate will be described in detail.

The FED is a display device in which a phosphor is exited by an electron beam to emit light. The FED can be classified into a diode FED, a triode FED, and a tetrode FED according to the configuration of electrodes.

The diode FED has a structure where a rectangular cathode electrode is formed on a surface of a first substrate while a rectangular anode electrode is formed on a surface of a second substrate, and the cathode electrode and the anode electrode cross each other with a distance of several μm to several mm interposed therebetween. An electron beam is emitted between the electrodes at an intersection in a vacuum space between the cathode electrode and the anode electrode by setting a potential difference of 10 kV or lower. These electrons reach the phosphor layer provided to the cathode electrode to excite the phosphor and emit light, whereby an image can be displayed.

The triode FED has a structure where a gate electrode crossing a cathode electrode with an insulating film interposed therebetween is formed over a first substrate provided with the cathode electrode. The cathode electrode and the gate electrode are arranged in rectangular or in matrix, and an electron-emission element is formed in an intersection portion, which includes the insulating film, of the cathode electrode and the gate electrode. By applying a voltage to the cathode electrode and the gate electrode, an electron beam is emitted from the electron-emission element. This electron beam is pulled toward the anode electrode of the second substrate to which a voltage higher than the voltage applied to the gate electrode is applied, whereby the phosphor layer provided to the anode electrode is excited, so that an image can be displayed by light emission.

The tetrode FED has a structure where a placoid or thin film focusing electrode having an opening is formed in each pixel between a gate electrode and an anode electrode of the triode FED. By focusing electron beams emitted from an electron-emission element in each pixel by the focusing electrode, the phosphor layer provided to the anode electrode can be excited, and thus, an image can be displayed by light emission.

Figure 15:
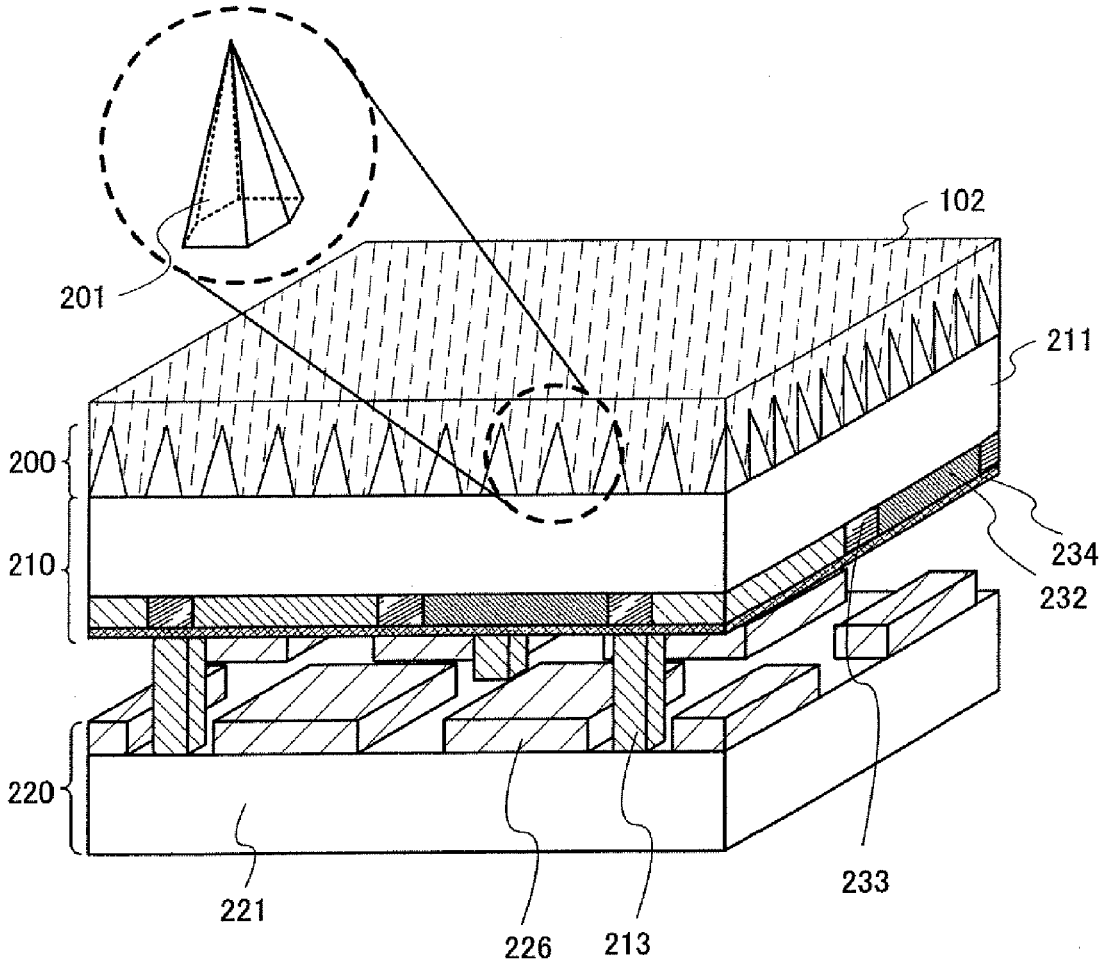
FIG. 15 is a perspective diagram showing an FED of the present invention.

FIG. 15 is a perspective diagram of an FED. As shown in FIG. 15, a front substrate 210 and a back substrate 220 are opposed to each other, and the periphery of the front substrate 210 and the back substrate 220 are sealed with a sealant (not shown). In order to keep a constant space between the front substrate 210 and the back substrate 220, a spacer 213 is provided between the front substrate 210 and the back substrate 220. In addition, an enclosed region of the front substrate 210, the back substrate 220, and the sealant is held in a vacuum. When an electron beam moves in the enclosed region, a phosphor layer 232 which is provided to an anode electrode or a metal back is exited to emit light, and a given cell is made to emit light; thus, a display image is obtained.

The discharge cells of a display portion are arranged in matrix.

In the front substrate 210, the phosphor layer 232 is farmed on one surface of a first light-transmitting substrate 211. A metal back 234 is formed on the phosphor layer 232. Note that an anode electrode may be formed between the first light-transmitting substrate 211 and the phosphor layer 232. For the anode electrode, a rectangular conductive layer which extends in the first direction can be formed.

An anti-reflection layer 200 is formed on the other surface of the first light-transmitting substrate 211. The anti-reflection layer 200 includes a pyramidal projection 201 and the protective layer 102. As the pyramidal projection 201 and the protective layer 102, the pyramidal projection and the protective layer described in Embodiment Mode 1 can be used, respectively.

In the back substrate 220, an electron-emission element 226 is formed on one surface of a second light-transmitting substrate 221. As the electron-emission element, various structures are proposed. Specifically, there are a Spindt-type electron-emission element, a surface-conduction electron-emission element, a ballistic-electron plane-emission-type electron-emission element, a metal-insulator-metal (MIM) element, a carbon nanotube, graphite nanofiber, diamond-like carbon (DLC), and the like.

Figure 18A:
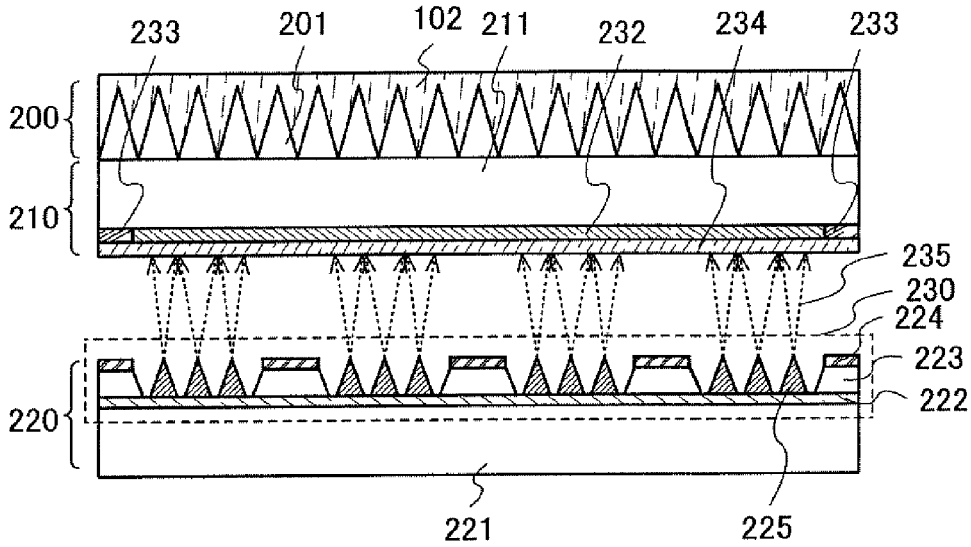
FIGS. 18A and 18B are cross-sectional views showing an FED of the present invention.
Figure 18B:
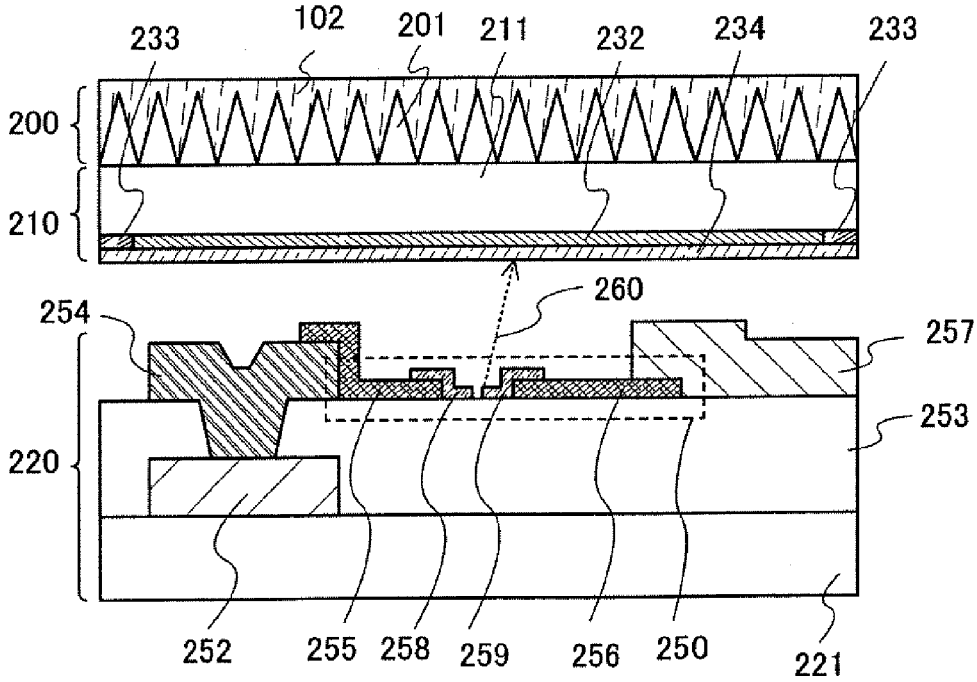

Here, a typical electron-emission element is shown with reference to FIGS. 18A and 18B.

FIG. 18A is a cross-sectional view of a cell of an FED having a Spindt-type electron-emission element.

A cathode electrode 222 and cone-shaped electron sources 225 formed over the cathode electrode 222 are included in a Spindt-type electron-emission element 230. The cone-shaped electron sources 225 are formed of a metal or a semiconductor. A gate electrode 224 is arranged in the periphery of the cone-shaped electron sources 225. Note that the gate electrode 224 and the cathode electrode 222 are insulated from each other with an interlayer insulating layer 223.

When a voltage is applied between the gate electrode 224 and the cathode electrode 222 formed in the back substrate 220, an electric field concentrates on each apical portion of the cone-shaped electron sources 225 to increase the intensity of the electric field, so that electrons are emitted into a vacuum from a metal or a semiconductor which forms the cone-shaped electron sources 225 by tunneling. On the other hand, the front substrate 210 is provided with the metal back 234 (or an anode electrode) and the phosphor layer 232. By applying a voltage to the metal back 234 (or the anode electrode), an electron beam 235 emitted from the cone-shaped electron sources 225 is guided to the phosphor layer 232, and a phosphor is exited, so that light emission can be obtained. Therefore, the cone-shaped electron sources 225 surrounded by the gate electrode 224 can be arranged in matrix, and light emission of each cell can be controlled by selectively applying a voltage to the cathode electrode, the metal back (or the anode electrode), and the gate electrode.

The Spindt-type electron-emission element has advantages in that (1) an electron extraction efficiency is high since it has a structure where an electron-emission element is arranged in a central region of a gate electrode with the largest concentration of the electric field, (2) in-plane uniformity of an extraction current of an electron-emission element is high since patterns having the arrangement of electron-emission elements can be accurately drawn to set suitable arrangement for electric field distribution, and the like.

Next, a structure of the cell having the Spindt-type electron-emission element is described. The front substrate 210 includes the first light-transmitting substrate 211, the phosphor layer 232 and a black matrix 233 formed on the first light-transmitting substrate 211, and the metal back 234 formed on the phosphor layer 232 and the black matrix 233.

As the first light-transmitting substrate 211, a substrate similar to the first light-transmitting substrate 111 described in Embodiment Mode 2 can be used.

For the phosphor layer 232, a fluorescent material to be excited by the electron beam 235 can be used. Further, as the phosphor layer 232, phosphor layers of RGB can be provided with rectangular arrangement, lattice arrangement, or delta arrangement, so that color display is possible. As a typical example, $Y_2O_2S$:Eu (red), $Zn_2SiO_4$:Mn (green), ZnS:Ag,Al (blue), and the like can be given. Other than these, a fluorescent material which is excited by a known electron beam can also be used.

The black matrix 233 is formed between the respective phosphor layers 232. By providing the black matrix, discrepancy in emission color due to misalignment of an irradiated position of the electron beam 235 can be prevented. Further, by providing conductivity to the black matrix 233, the charge-up of the phosphor layer 232 due to an electron beam can be prevented. For the black matrix 233, carbon particles can be used. Note that a known black matrix material for an FED can also be used.

The phosphor layer 232 and the black matrix 233 can be formed using a slurry process or a printing method. In the slurry process, a composition in which the fluorescent material or carbon particles are mixed into a photosensitive material, a solvent, or the like is applied by spin coating and dried, and then exposed and developed.

The metal back 234 can be formed using a conductive thin film of aluminum or the like having a thickness of 10 nm to 200 nm, preferably a thickness of 50 nm to 150 nm. By providing the metal back 234, light which is emitted from the phosphor layer 232 and goes to the back substrate 220 side can be reflected toward the first light-transmitting substrate 211, so that luminance can be improved. In addition, the metal back 234 can prevent the phosphor layer 232 from being damaged by shock of ions which are generated in such a way that a gas which remains in a cell is ionized by the electron beam 235. The metal back 234 can guide the electron beam 235 to the phosphor layer 232 because the metal back 234 plays a role as an anode electrode with respect to the electron-emission element 230. The metal back 234 can be formed in such a way that a conductive layer is formed by a sputtering method and then selectively etched.

The back substrate 220 is formed of the second light-transmitting substrate 221, the cathode electrode 222 formed over the second light-transmitting substrate 221, the cone-shaped electron sources 225 formed over the cathode electrode 222, the interlayer insulating layer 223 which separates the electron sources 225 into each cell, and the gate electrode 224 formed over the interlayer insulating layer 223.

As the second light-transmitting substrate 221, a substrate similar to the second light-transmitting substrate 121 described in Embodiment Mode 2 can be used.

The cathode electrode 222 can be formed using tungsten, molybdenum, niobium, tantalum, titanium, chromium, aluminum, copper, or ITO. As a method for forming the cathode electrode 222, an electron beam evaporation method, a thermal evaporation method, a printing method, a plating method, or the like can be used. Further, a conductive layer is formed by a sputtering method, a CVD method, an ion plating method, or the like over an entire surface, and then, the conductive layer is selectively etched by using a resist mask or the like, so that the cathode electrode 222 can be formed. When an anode electrode is formed, the cathode electrode can be formed of a rectangular conductive layer which extends in the first direction parallel to the anode electrode.

The electron sources 225 can be formed using tungsten, a tungsten alloy, molybdenum, a molybdenum alloy, niobium, a niobium alloy, tantalum, a tantalum alloy, titanium, a titanium alloy, chromium, a chromium alloy, silicon which imparts n-type conductivity (doped with phosphorus), or the like.

The interlayer insulating layer 223 can be formed using the following: an inorganic siloxane polymer including a Si—O—Si bond among compounds including silicon, oxygen, and hydrogen formed by using a siloxane polymer-based material as a starting material, which is typified by silica glass; or an organic siloxane polymer in which hydrogen bonded to silicon is substituted by an organic group such as methyl or phenyl, which is typified by an alkylsiloxane polymer, an alkylsilsesquioxane polymer, a silsesquioxane hydride polymer, or an alkylsilsesquioxane hydride polymer. When the interlayer insulating layer 223 is formed using the above material, a coating method, a printing method, or the like is used. Alternatively, as the interlayer insulating layer 223, a silicon oxide layer may be formed by a sputtering method, a CVD method, or the like. Note that, in regions where the electron sources 225 are formed, the interlayer insulating layer 223 is provided with openings.

The gate electrode 224 can be formed using tungsten, molybdenum, niobium, tantalum, chromium, aluminum, copper, or the like. As a method for forming the gate electrode 224, the method for forming the cathode electrode 222 can be used, as appropriate. The gate electrode 224 can be formed of a rectangular conductive layer which extends in the second direction that intersects with the first direction at 90°. Note that, in the regions where the electron sources 225 are formed, the gate electrode is provided with openings.

Note that, in a space between the gate electrode 224 and the metal back 234, that is, in a space between the front substrate 210 and the back substrate 220, a focusing electrode may be formed. The focusing electrode is provided in order to focus an electron beam emitted from the electron-emission element. By providing the focusing electrode, light emission luminance of the light-emission cell can be improved, reduction in contrast due to color mixture of adjacent cells can be suppressed, or the like. A negative voltage is preferably applied to the focusing electrode, compared with the metal back (or the anode electrode).

Next, a structure of a cell of an FED having a surface-conduction electron-emission element is described. FIG. 18B is a cross-sectional view of the cell of the FED having the surface-conduction electron-emission element.

A surface-conduction electron-emission element 250 is formed of element electrodes 255 and 256 which are opposed to each other, and conductive layers 258 and 259 which come into contact with the element electrodes 255 and 256, respectively. The conductive layers 258 and 259 have a space portion. When a voltage is applied to the element electrodes 255 and 256, an intense electric field is generated in the space portion, and electrons are emitted from one of the conductive layers to the other thereof due to a tunnel effect. By applying a positive voltage to the metal back 234 (or the anode electrode) provided in the front substrate 210, the electrons emitted from one of the conductive layers to the other thereof is guided to the phosphor layer 232. When this electron beam 260 excites a phosphor, light emission can be obtained.

Therefore, the surface-conduction electron-emission elements are arranged in matrix, and a voltage is selectively applied to the element electrodes 255 and 256 and the metal back (or the anode electrode), so that light emission of each cell can be controlled.

Because a drive voltage of the surface-conduction electron-emission element is low, compared with other electron-emission elements, power consumption of the FED can be lowered.

Next, a structure of a cell having a surface-conduction electron-emission element is described. The front substrate 210 includes the first light-transmitting substrate 211, the phosphor layer 232 and the black matrix 233 formed on the first light-transmitting substrate 211, and the metal back 234 formed on the phosphor layer 232 and the black matrix 233. Note that an anode electrode may be formed between the first light-transmitting substrate 211 and the phosphor layer 232. For the anode electrode, a rectangular conductive layer which extends in the first direction can be formed.

The back substrate 220 is formed of the second light-transmitting substrate 221, a row direction wiring 252 formed over the second light-transmitting substrate 221, an interlayer insulating layer 253 formed over the row direction wiring 252 and the second light-transmitting substrate 221, a connection wiring 254 connected to the row direction wiring 252 with the interlayer insulating layer 253 interposed therebetween, the element electrode 255 which is connected to the connection wiring 254 and formed over the interlayer insulating layer 253, the element electrode 256 formed over the interlayer insulating layer 253, a column direction wiring 257 connected to the element electrode 256, the conductive layer 258 which comes into contact with the element electrode 255, and the conductive layer 259 which comes into contact with the element electrode 256. Note that the electron-emission element 250 shown in FIG. 18B is a pair of the element electrodes 255 and 256 and a pair of the conductive layers 258 and 259.

The row direction wiring 252 can be formed using a metal such as titanium, nickel, gold, silver, copper, aluminum, or platinum; or an alloy of these. As a method for forming the row direction wiring 252, a droplet discharge method, a vacuum evaporation method, a printing method, or the like can be used. Alternatively, the row direction wiring 252 can be formed in such a way that a conductive layer formed by a sputtering method, a CVD method, or the like is selectively etched. The thickness of each of the element electrodes 255 and 256 is preferably 20 nm to 500 nm.

As the interlayer insulating layer 253, a material and a formation method similar to those of the interlayer insulating layer 223 shown in FIG. 18A can be used, as appropriate. The thickness of the interlayer insulating layer 253 is preferably 500 nm to 5 μm.

As the connection wiring 254, a material and a formation method similar to those of the row direction wiring 252 can be used, as appropriate.

The pair of the element electrodes 255 and 256 can be formed using a metal such as chromium, copper, iridium, molybdenum, palladium, platinum, titanium, tantalum, tungsten, or zirconium; or an alloy of these. As a method for forming the element electrodes 255 and 256, a droplet discharge method, a vacuum evaporation method, a printing method, or the like can be used. The element electrodes 255 and 256 can be formed in such a way that a conductive layer formed by a sputtering method, a CVD method, or the like is selectively etched. The thickness of each of the element electrodes 255 and 256 is preferably 20 nm to 500 nm.

As the column direction wiring 257, a material and a formation method similar to those of the row direction wiring 252 can be used, as appropriate.

As a material of the pair of the conductive layers 258 and 259, a metal such as palladium, platinum, chromium, titanium, copper, tantalum, or tungsten; oxide such as palladium oxide, tin oxide, a mixture of indium oxide and antimony oxide; silicon; carbon; or the like can be used, as appropriate. Further, a stack using a plurality of the above materials may be used. In addition, the conductive layers 258 and 259 can be formed using particles of any of the above materials. Note that an oxide layer may be formed around the particles of any of the above materials. By using the particles having an oxide layer, electrons can be accelerated and easily emitted. As a method for forming the conductive layers 258 and 259, a droplet discharge method, a vacuum evaporation method, a printing method, or the like can be used. The thickness of each of the conductive layers 258 and 259 is preferably 0.1 nm to 50 nm.

A distance of the space portion formed between the pair of the conductive layers 258 and 259 is preferably 100 nm or less, more preferably, 50 nm or less. The space portion can be formed by cleavage by application of a voltage to the conductive layers 258 and 259 or cleavage by using a focused ion beam. Alternatively, the space portion can be formed by performing selective etching by wet etching or dry etching with the use of a resist mask.

Note that a focusing electrode may be formed in the space between the front substrate 210 and the back substrate 220. By providing the focusing electrode, an electron beam emitted from the electron-emission element can be focused, light emission luminance of the cell can be improved, reduction in contrast due to color mixture of adjacent cells can be suppressed, or the like. A negative voltage is preferably applied to the focusing electrode, compared with the metal back 234 (or the anode electrode).

Next, a method for forming an FED panel is described hereinafter

In the periphery of the back substrate 220, glass for sealing is printed by a printing method and then pre-baked. Next, the front substrate 210 and the back substrate 220 are aligned, temporally fixed to each other, and then heated. As a result, the glass for sealing is melted and cooled, whereby the front substrate 210 and the back substrate 220 are attached together so that a panel is made. Next, the inside of the panel is drawn down to vacuum while the panel is being heated. Next, by heating a vent pipe provided for the back substrate 220, an open end of the vent pipe is blocked and the inside of the panel is vacuum locked. Accordingly, the FED panel can be completed.

Figure 16:
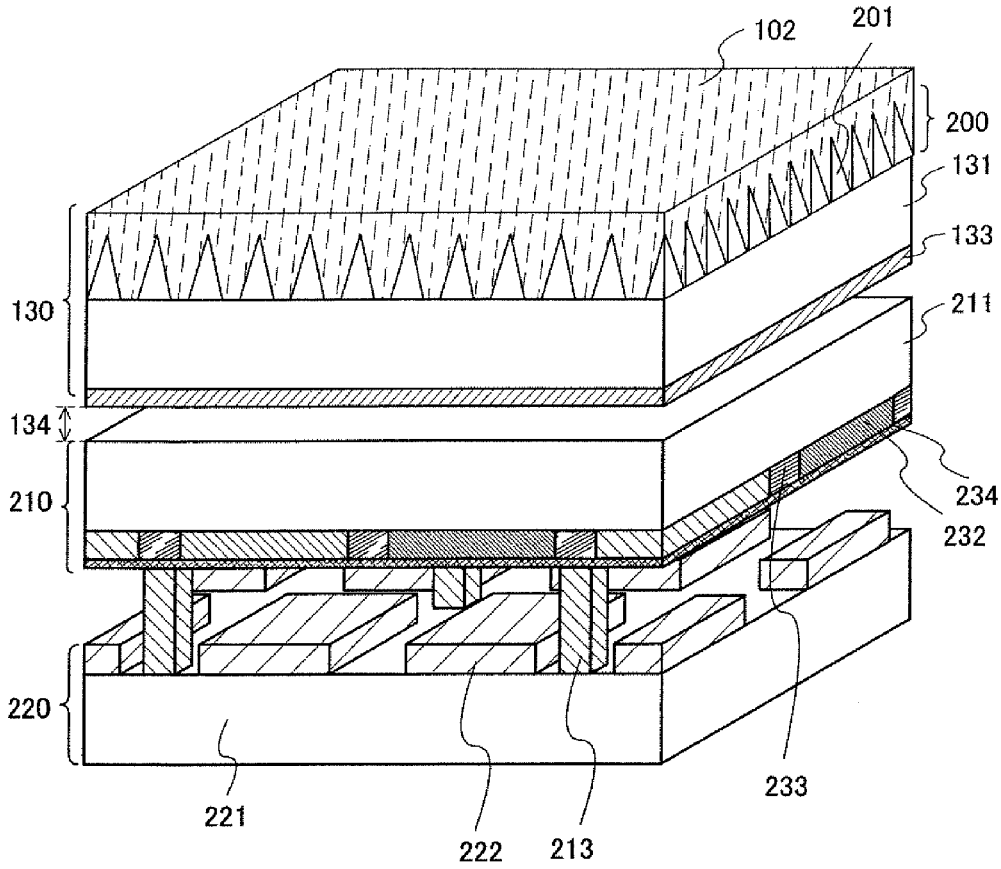
FIG. 16 is a perspective diagram showing an FED of the present invention.

As an FED, as shown in FIG. 16, a panel in which the front substrate 210 and the back substrate 220 are sealed may be provided with the optical filter 130 in which the electromagnetic wave shield layer 133 as described in Embodiment Mode 2 is formed on one surface of the light-transmitting substrate 131 and the anti-reflection layer 200 as described in Embodiment Mode 1 is formed on the other surface of the light-transmitting substrate 131. Note that in FIG. 16, a mode is shown in which the anti-reflection layer 200 is not formed on a surface of the first light-transmitting substrate 211 of the front substrate 210; however, an anti-reflection layer described in Embodiment Mode 1 may also be provided on the surface of the first light-transmitting substrate 211 of the front substrate 210. With such a structure, reflectance of incident light from external can be reduced further.

Figure 17:
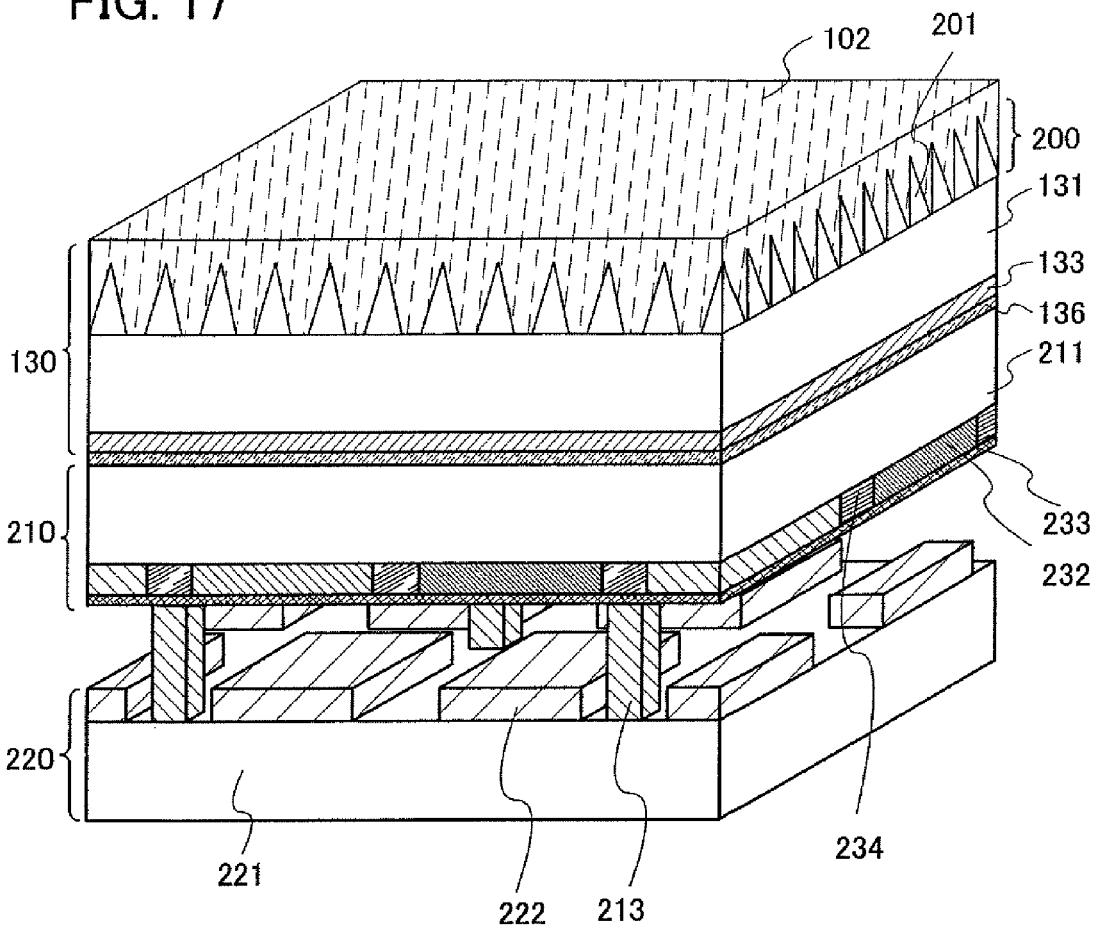
FIG. 17 is a perspective diagram showing an FED of the present invention.

Note that in FIG. 16, the front substrate 210 and the optical filter 130 are provided with the space 134 interposed therebetween; however, as shown in FIG. 17, the optical filter 130 and the front substrate 210 may be attached to each other by using the adhesive 136.

In particular, when a plastic is used for the light-transmitting substrate 131 and the optical filter 130 is provided on the surface of the front substrate 210 by use of the adhesive 136, reductions in thickness and weight of the FED can be achieved.

Note that here, the structure in which the optical filter 130 is provided with the electromagnetic wave shield layer 133 and the anti-reflection layer 200 is described; however, a near-infrared ray shielding layer may be provided as well as the electromagnetic wave shield layer 133 in a manner similar to Embodiment Mode 2. Furthermore, one functional layer that has an electromagnetic wave shield function and a near-infrared ray shielding function may be formed.

Figure 19:
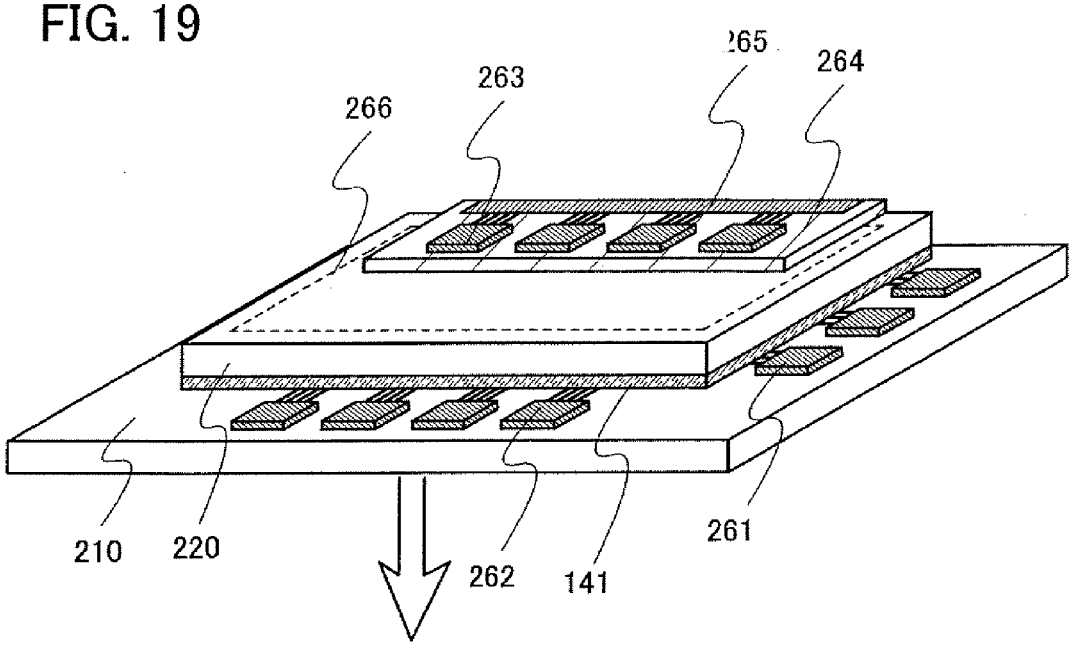
FIG. 19 is a perspective diagram showing an FED module of the present invention.
Figure 20:
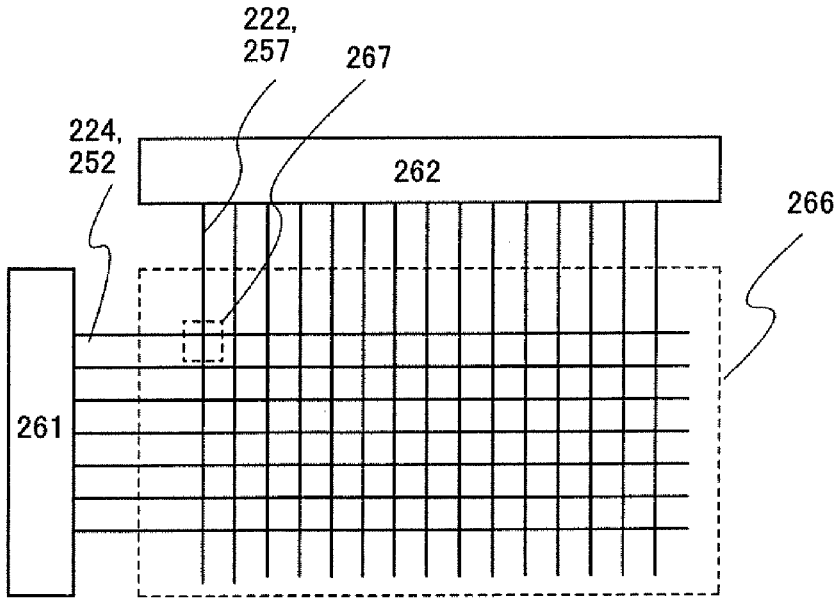
FIG. 20 is a diagram showing an FED of the present invention.

Next, an FED module having the Spindt-type electron-emission element and a driving method thereof are described with reference to FIG. 18A, FIG. 19, and FIG. 20. FIG. 19 is a perspective diagram of the FED module. FIG. 20 is a schematic diagram of the FED module.

As shown in FIG. 19, the periphery of the front substrate 210 and the back substrate 220 is sealed with the glass 141 for sealing. A driver circuit 261 that drives a row electrode and a driver circuit 262 that drives a column electrode are provided over the first light-transmitting substrate which is part of the front substrate 210. The driver circuit 261 is connected to the row electrode, and the driver circuit 262 is connected to the column electrode.

Over the second light-transmitting substrate which is part of the back substrate 220, a driver circuit 263 which applies a voltage to a metal back (or an anode electrode) is provided and connected to the metal back (or the anode electrode). Here, the driver circuit 263 which applies a voltage to the metal back (or the anode electrode) is provided over a wiring board 264, and the driver circuit 263 and the metal back (or the anode electrode) are connected through an FPC 265. Further, although not shown, a control circuit which controls the driver circuits 261 to 263 is provided over the first light-transmitting substrate 211 or the second light-transmitting substrate 221.

As shown in FIG. 18A and FIG. 20, a light-emission cell 267 of a display portion 266 is selected by using the driver circuit 261 which drives a row electrode and the driver circuit 262 which drives a column electrode based on image data inputted from a control portion; a voltage is applied to the gate electrode 224 and the cathode electrode 222 in the light-emission cell 267; and an electron beam is emitted from the electron-emission element 230 of the light-emission cell 267. In addition, an anode voltage is applied to the metal back 234 (or the anode electrode) with the driver circuit which applies a voltage to the metal back 234 (or the anode electrode). The electron beam 235 emitted from the electron-emission element 230 of the light-emission cell 267 is accelerated by the anode voltage; a surface of the phosphor layer 232 of the front substrate 210 is irradiated with the electron beam 235 to excite a phosphor; and the phosphor emits light, so that the light can be emitted to the outer side of the front substrate. In addition, a given cell is selected by the above method, so that an image can be displayed.

Next, an FED module having the surface-conduction electron-emission element and a driving method thereof are described with reference to FIG. 18B, FIG. 19, and FIG. 20.

As shown in FIG. 19, the periphery of the front substrate 210 and the back substrate 220 is sealed with the glass 141 for sealing. The driver circuit 261 that drives a row electrode and the driver circuit 262 that drives a column electrode are provided over the first light-transmitting substrate which is part of the front substrate 210. The driver circuit 261 is connected to the row electrode and the driver circuit 262 is connected to the column electrode.

Over the second light-transmitting substrate which is part of the back substrate 220, the driver circuit 263 which applies a voltage to the metal back (or the anode electrode) is provided and connected to the metal back (or the anode electrode). Although not shown, a control circuit which controls the driver circuits 261 to 263 is provided over the first light-transmitting substrate or the second light-transmitting substrate.

As shown in FIG. 18B and FIG. 20, the light-emission cell 267 of the display portion 266 is selected by using the driver circuit 261 which drives a row electrode and the driver circuit 262 which drives a column electrode based on image data inputted from a control portion; a voltage is applied to the row direction wiring 252 and the column direction wiring 257 in the light-emission cell 267; a voltage is applied between the element electrodes 255 and 256; and the electron beam 260 is emitted from the electron-emission element 250 of the light-emission cell 267. In addition, an anode voltage is applied to the metal back 234 (or the anode electrode) with the driver circuit 263 which applies a voltage to the metal back 234 (or the anode electrode). The electron beam emitted from the electron-emission element 250 is accelerated by the anode voltage; the surface of the phosphor layer 232 of the front substrate 210 is irradiated with the electron beam to excite a phosphor; and the phosphor emits light, so that the light can be emitted to the outer side of the front substrate. In addition, a given cell is selected by the above method, so that an image can be displayed.

The FED described in this embodiment mode includes the anti-reflection layer on its surface. The anti-reflection layer includes a plurality of pyramidal projections, and incident light from external is reflected not to a viewer side but to another adjacent pyramidal projection because the side of each pyramidal projection is not perpendicular to the direction of incidence of incident light from external. Alternatively, reflected light of incident light from external propagates between the adjacent pyramidal projections. One part of incident light enters an adjacent pyramidal projection, and the other part of the incident light is then incident on an adjacent pyramidal projection as reflected light. In this manner, incident light from external reflected at the surface of the side of a pyramidal projection is repeatedly incident on adjacent pyramidal projections.

In other words, the number of times which is incident on the pyramidal projections of the FED of incidence of incident light from external is increased; therefore, the amount of incident light from external entering the pyramidal projection is increased. Thus, the amount of incident light from external reflected to a viewer side is reduced, and a cause of the reduction in visibility such as reflection can be prevented.

In a display screen, since incident light from external is reflected to a viewer side when there is a planar portion (a surface parallel to the display screen) with respect to incident light from external, a smaller planar region has a high antireflection function. In addition, it is preferable that a surface of a display screen be formed of a plurality of side surfaces of a pyramidal projection which face in different directions with respect to a base for diffusing incident light from external.

The hexagonal pyramidal projection in this embodiment mode can have a close-packed structure without any spaces and has an optimal shape from among such shapes, having the largest number of sides of a pyramidal projection and a high anti-reflection function that can diffuse light in many directions efficiently.

The distance between apexes of the plurality of adjacent pyramidal projections is preferably 350 nm or less, and the height of the plurality of pyramidal projections is preferably 800 nm or higher. In addition, the filling factor of a base of the plurality of pyramidal projections per unit area over the surface of the substrate that is to serve as a display screen is preferably 80% or more, more preferably, 90% or more. Under the above conditions, since the ratio of incident light from external, which is incident on a planar portion is reduced, light can be prevented from being reflected to a viewer side, which is preferable.

The pyramidal projection can be formed not of a material with a uniform refractive index but of a material whose refractive index changes from an apical portion of the pyramidal projection to a portion closer to a substrate that is to serve as a display screen. For example, in each of the plurality of pyramidal projections, a structure is used in which a portion closer to the apical portion of each pyramidal projection can be formed of a material having a refractive index equivalent to that of the air or the protective layer to further reduce reflection of incident light from external which is incident on the surface of each pyramidal projection from the air. Meanwhile, a structure is used in which a portion closer to the substrate that is to serve as the display screen is formed of a material having a refractive index equivalent to that of the substrate so that reflection of light which propagates inside each pyramidal projection and is incident on the substrate is reduced at the interface between each pyramidal projection and the substrate. When a glass substrate is used for the substrate, the refractive index of the air or the protective layer is lower than that of the glass substrate. Therefore, each pyramidal projection may have a structure which is formed in such a manner that a portion closer to an apical portion of each pyramidal projection is formed of a material having a lower refractive index and a portion closer to a base of each pyramidal projection is formed of a material having a higher refractive index, that is, the refractive index increases from the apical portion to the base of each pyramidal projection.

Furthermore, since the protective layer is formed in the space among the pyramidal projections in the present invention, the entry of a contaminant, such as dust, into the space among the pyramidal projections can be prevented. Therefore, a decrease in anti-reflection function due to the entry of dust or the like can be prevented, and the physical strength of the FED can be increased by filling the space among the pyramidal projections. Accordingly, reliability can be improved.

The FED described in this embodiment mode includes a high anti-reflection function that can further reduce reflection of incident light from external by providing the anti-reflection layer having a plurality of adjacent pyramidal projections to its surface and the anti-reflection layer provided with the protective layer in the space among the pyramidal projections. Therefore, an FED having high visibility can be provided. Accordingly, an FED having higher quality and higher performance can be manufactured.

Embodiment Mode 4

Figure 22:
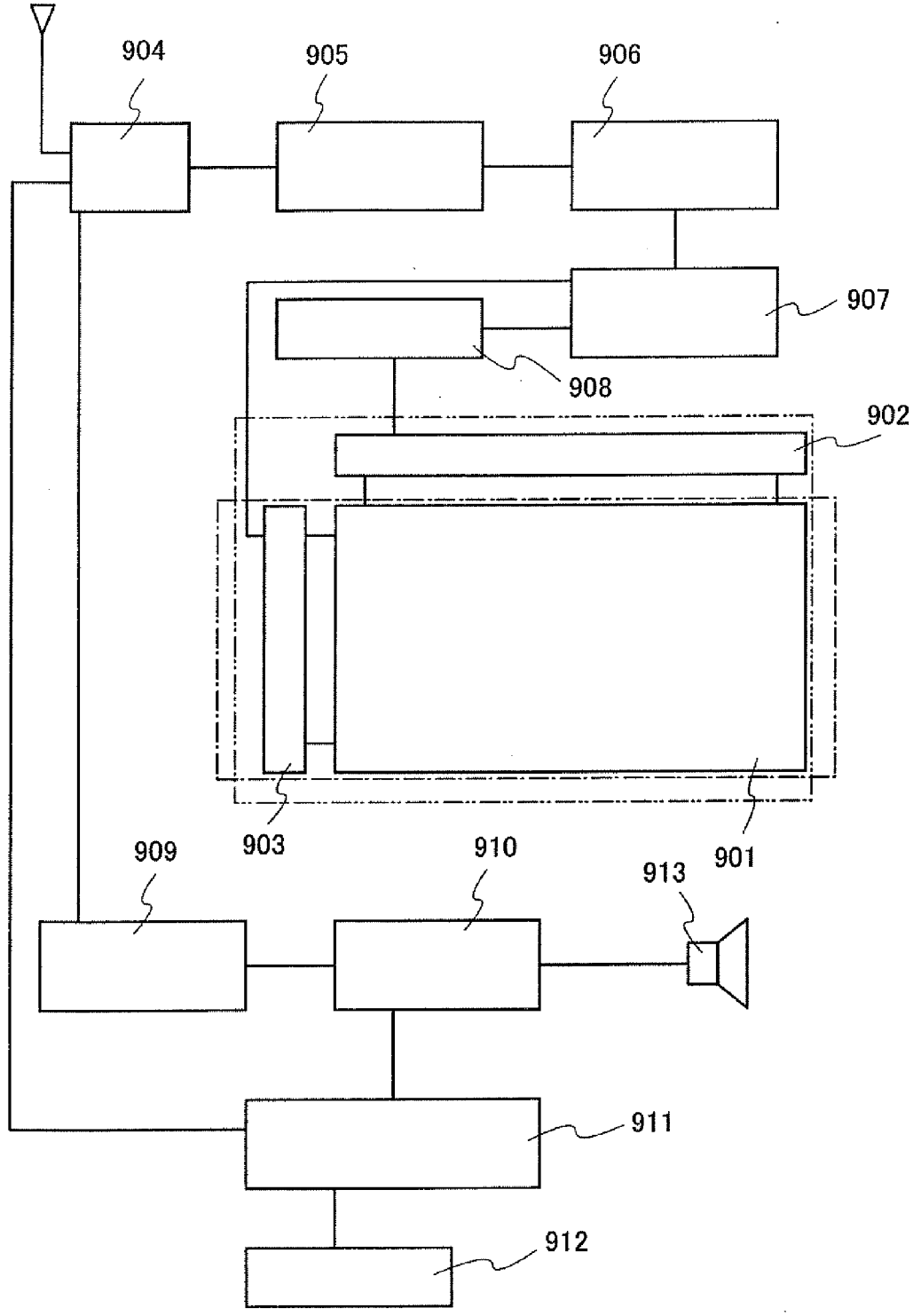
FIG. 22 is a block diagram showing a main structure of an electronic device to which the present invention is applied.

With the PDP and the FED of the present invention, a television device (also simply referred to as a television, or a television receiver) can be completed. FIG. 22 is a block diagram showing main components of the television device.

Figure 21A:
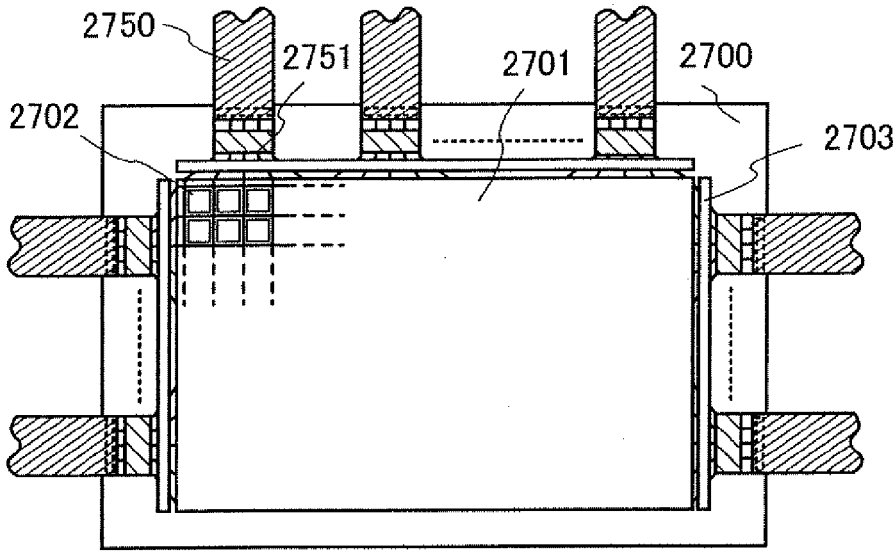
FIGS. 21A and 21B are top views showing a display device of the present invention.

FIG. 21A is a top view showing a structure of a PDP panel or an FED panel (hereinafter referred to as a display panel). A pixel portion 2701 in which pixels 2702 are arranged in matrix and an input terminal 2703 are formed over a substrate 2700 having an insulating surface. The number of pixels may be determined in accordance with various standards. In the case of XGA full-color display using RGB, the number of pixels may be 1024×768×3 (RGB). In the case of UXGA full-color display using ROB, the number of pixels may be 1600×1200×3 (ROB), and in the case of full-spec, high-definition, and full-color display using RGB, the number may be 1920×1080×3 (RGB).

Figure 21B:
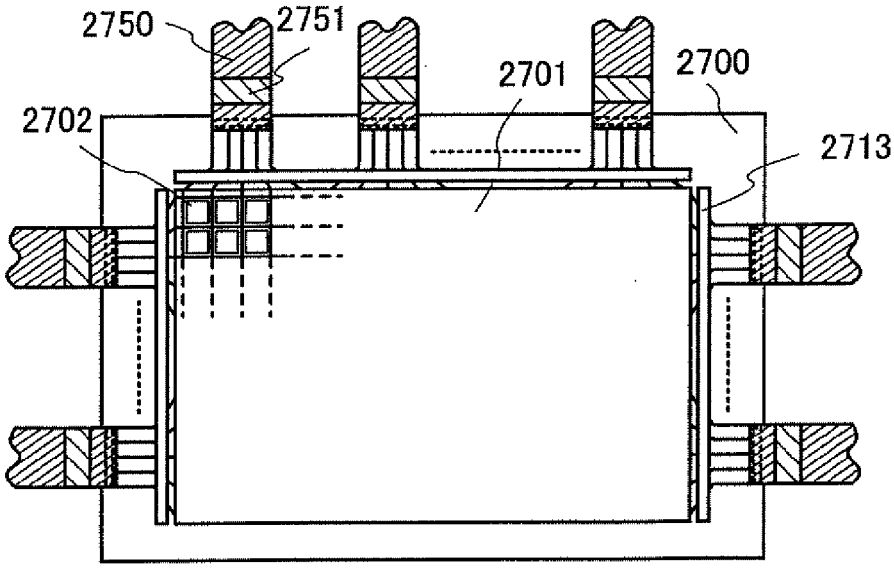

A driver IC 2751 may be mounted on the substrate 2700 by a chip on glass (COG) method as shown in FIG. 21A. As another mounting mode, a tape automated bonding (TAB) method may be used as shown in FIG. 21B. The driver IC may be formed using a single crystal semiconductor substrate or may be formed using a TFT over a glass substrate. In each of FIGS. 21A and 21B, the driver IC 2751 is connected to a flexible printed circuit (FPC) 2750.

As another structure of an external circuit in FIG. 22, an input side of the video signal is provided as follows: a video signal amplifier circuit 905 which amplifies a video signal among signals received by a tuner 904; a video signal processing circuit 906 which converts the signals outputted from the video signal amplifier circuit 905 into chrominance signals corresponding to respective colors of red, green, and blue; a control circuit 907 which converts the video signal into an input specification of the driver IC; and the like. The control circuit 907 outputs signals to both a scan line side and a signal line side. In the case of digital drive, a signal dividing circuit 908 may be provided on the signal line side and an input digital signal may be divided into m pieces and supplied.

Among signals received by the tuner 904, an audio signal is transmitted to an audio signal amplifier circuit 909, and an output thereof is supplied to a speaker 913 through an audio signal processing circuit 910. A control circuit 911 receives control information of a receiving station (reception frequency) or sound volume from an input portion 912 and transmits signals to the tuner 904 and the audio signal processing circuit 910.

Figure 23A:
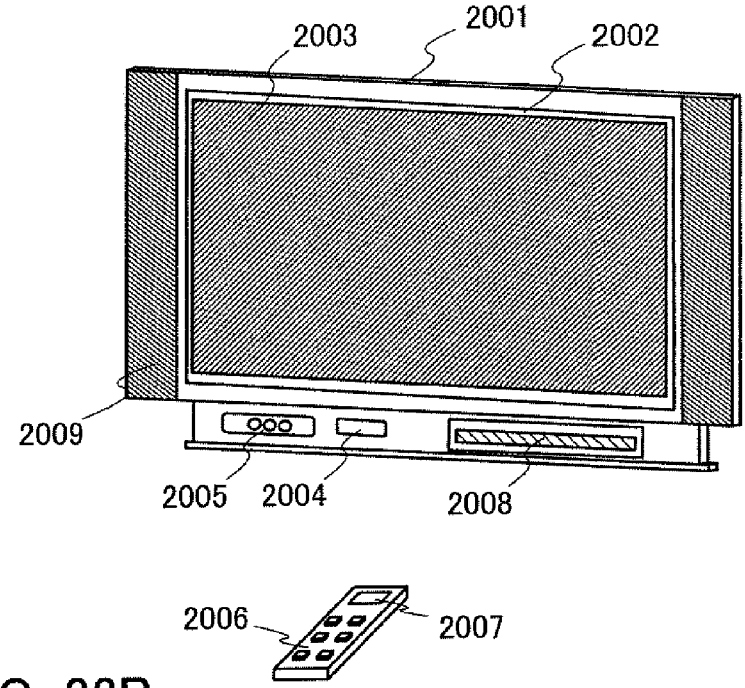
FIGS. 23A and 23B are diagram showing electronic devices of the present invention.
Figure 23B:
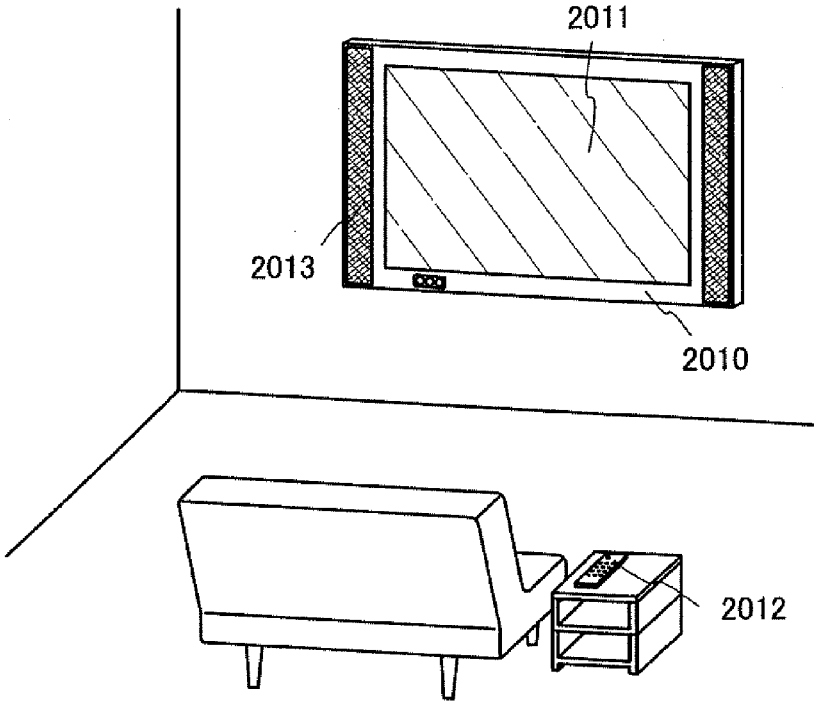

A television device can be completed by incorporating the display module into a chassis as shown in FIGS. 23A and 23B. When a PDP module is used as a display module, a PDP television device can be manufactured. When an FED module is used, an FED television device can be manufactured. In FIG. 23A, a main screen 2003 is formed by using the display module, and a speaker portion 2009, an operation switch, and the like are provided as its accessory equipment. Thus, a television device can be completed in accordance with the present invention.

A display panel 2002 is incorporated in a chassis 2001, and general TV broadcast can be received by a receiver 2005. When the display device is connected to a communication network by wired or wireless connections via a modem 2004, one-way (from a sender to a receiver) or two-way (between a sender and a receiver or between receivers) information communication can be performed. The television device can be operated by a switch built in the chassis 2001 or a remote control unit 2006. A display portion 2007 for displaying output information may also be provided in the remote control device 2006.

Further, the television device may include a sub screen 2008 formed using a second display panel so as to display channels, volume, or the like, as well as the main screen 2003.

FIG. 23B shows a television device having a large-sized display portion, for example, a 20-inch to 80-inch display portion. The television device includes a chassis 2010, a display portion 2011, a remote control device 2012 serving as an operation portion, a speaker portion 2013, and the like. This embodiment mode that uses the present invention is applied to manufacturing of the display portion 2011. Since the television device in FIG. 23B is a wall-hanging type, it does not require a large installation space.

Naturally, the present invention is not limited to the television device, and can be applied to various use applications, as a large-sized display medium such as an information display board at a train station, an airport, or the like, or an advertisement display board on the street, as well as a monitor of a personal computer.

This embodiment mode can be combined with any of Embodiment Modes 1 to 3, as appropriate.

Embodiment Mode 5

Examples of electronic devices using a PDP and an FED in accordance with the present invention are as follows: a television device (also simply referred to as a television, or a television receiver), a camera such as a digital camera or a digital video camera, a cellular telephone device (also simply referred to as a cellular phone or a cell-phone), a portable information terminal such as a PDA, a portable game machine, a computer monitor, a computer, a sound reproducing device such as a car audio system, an image reproducing device including a recording medium, such as a home-use game machine, and the like. In addition, the present invention can be applied to any game machine having a display device, such as a pachinko machine, a slot machine, a pinball machine, or a large-sized game machine. Specific examples of them are described with reference to FIGS. 24A to 24F.

Figure 24A:
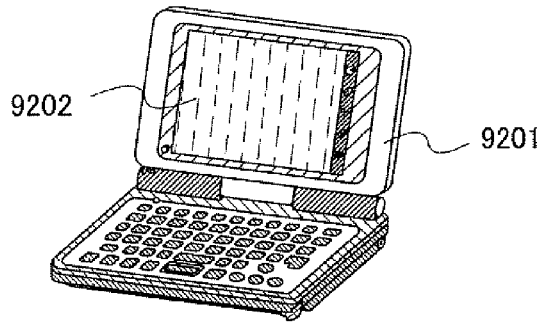
FIGS. 24A to 24F are diagrams showing electronic devices of the present invention.

A portable information terminal device shown in FIG. 24A includes a main body 9201, a display portion 9202, and the like. The FED of the present invention can be applied to the display portion 9202. As a result, a high-performance portable information terminal device which can display a high-quality image superior in visibility can be provided.

Figure 24B:
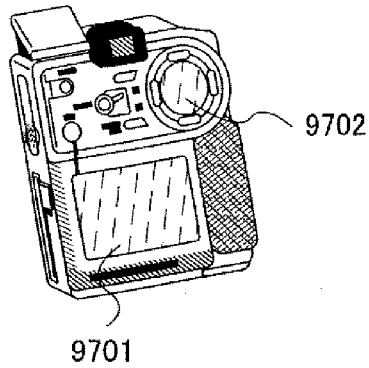

A digital video camera shown in FIG. 24B includes a display portion 9701, a display portion 9702, and the like. The FED of the present invention can be applied to the display portion 9701. As a result, a high-performance digital video camera which can display a high-quality image superior in visibility can be provided.

Figure 24C:
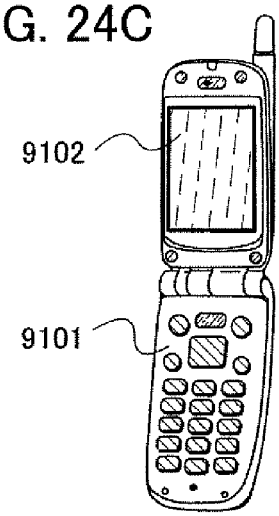

A cellular phone shown in FIG. 24C includes a main body 9101, a display portion 9102, and the like. The FED of the present invention can be applied to the display portion 9102. As a result, a high-performance cellular phone which can display a high-quality image superior in visibility can be provided.

Figure 24D:
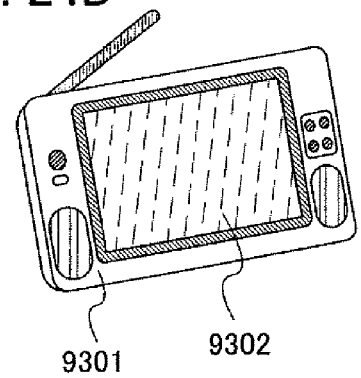

A portable television device shown in FIG. 24D includes a main body 9301, a display portion 9302, and the like. The PDP and the FED of the present invention can be applied to the display portion 9302. As a result, a high-performance portable television device which can display a high-quality image superior in visibility can be provided. The PDP and the FED of the present invention can be applied to a wide range of television devices ranging from a small-sized television device mounted on a portable terminal such as a cellular phone, a medium-sized television device which can be carried, to a large-sized (for example, 40-inch or larger) television device.

Figure 24E:
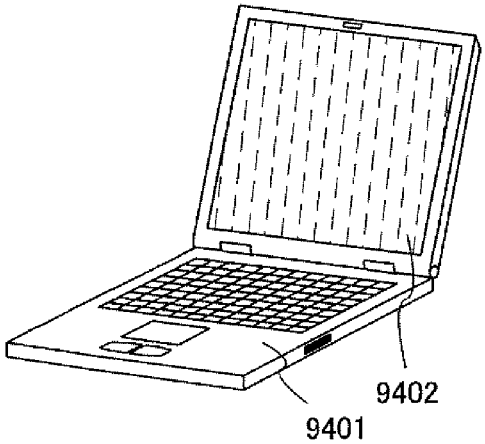

A portable computer shown in FIG. 24E includes a main body 9401, a display portion 9402, and the like. The FED of the present invention can be applied to the display portion 9402. As a result, a high-performance portable computer which can display a high-quality image superior in visibility can be provided.

Figure 24F:
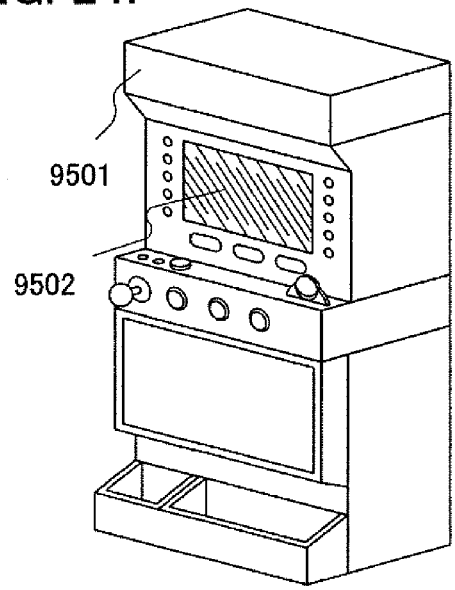

A slot machine shown in FIG. 24F includes a main body 9501, a display portion 9502, and the like. The display device of the present invention can be applied to the display portion 9502. As a result, a high-performance slot machine which can display a high-quality image superior in visibility can be provided.

As described above, using the display device of the present invention makes it possible to provide a high-performance electronic device which can display a high-quality image superior in visibility.

This embodiment mode can be combined with any of Embodiment Modes 1 to 4.

This application is based on Japanese Patent Application serial No. 2006-328213 filed in Japan Patent Office on Dec. 5, 2006, the entire contents of which are hereby incorporated by reference.

EXPLANATION OF REFERENCE

100: anti-reflection layer, 101: pyramidal projection, 102: protective layer, 110: front substrate, 111: light-transmitting substrate, 114: light-transmitting insulating layer, 115: protective layer, 116: plasma, 117: ultraviolet rays, 118: light emission, 120: back substrate, 121: light-transmitting substrate, 122: data electrode, 123: dielectric layer, 124: partition (rib), 125: phosphor layer, 130: optical filter, 131: light-transmitting substrate, 132: near-infrared ray shielding layer, 133: electromagnetic wave shield layer, 134: space, 135: electromagnetic wave absorber, 136: adhesive, 141: glass for sealing, 142: scan electrode driver circuit, 143: sustain electrode driver circuit, 144: data electrode driver circuit, 145: display portion, 146: wiring board, 147: FPC, 150: discharge cell, 200: anti-reflection layer, 201: pyramidal projection, 210: front substrate, 211: light-transmitting substrate, 213: spacer, 220: back substrate, 221: light-transmitting substrate, 222: cathode electrode, 223: interlayer insulating layer, 224: gate electrode, 225: electron source, 226: electron-emission element, 230: electron-emission element, 232: phosphor layer, 233: black matrix, 234: metal back, 235: electron beam, 250: electron-emission element, 252: row direction wiring, 253: interlayer insulating layer, 254: connection wiring, 255: element electrode, 256: element electrode, 257: column direction wiring, 258: conductive layer, 259: conductive layer,

260: electron beam, 261: driver circuit, 262: driver circuit, 263: driver circuit, 264: wiring board, 265: FPC, 266: display portion, 267: light-emission cell, 410: substrate, 414: incident light from external, 415: reflected light ray, 416: protective layer, 450: FED, 451: pyramidal projection, 452: protective layer, 470: substrate, 471: pyramidal projection, 480: substrate, 481: pyramidal projection, 486: film, 490: substrate, 491: pyramidal projection, 492: protective layer, 493: protective layer, 494: protective layer, 495: protective layer, 800: wavelength, 904: tuner, 905: video signal amplifier circuit, 906: video signal processing circuit, 907: control circuit, 908: signal dividing circuit, 909: audio signal amplifier circuit, 910: audio signal processing circuit, 911: control circuit, 912: input portion, 913: speaker, 112*a*: light-transmitting conductive layer, 112*b*: light-transmitting conductive layer, 113*a*: scan electrode, 113b: sustain electrode, 2001: chassis, 2002: display panel, 2003: main screen, 2004: modem, 2005: receiver, 2006: remote control device, 2007: display portion, 2008: sub screen, 2009: speaker portion, 2010: chassis, 2011: display portion, 2012: remote control device, 2013: speaker portion, 2700: substrate, 2701: pixel portion, 2702: pixel, 2703: input terminal, 2750: FPC (flexible printed circuit), 2751: driver IC, 411*a*: pyramidal projection, 411*b*: pyramidal projection, 411c: pyramidal projection, 411*d*: pyramidal projection, 412*a*: transmitted light ray, 412*b*: reflected light ray, 412*c*: reflected light ray, 412*d*: reflected light ray, 413*a*: transmitted light ray, 413*b*: transmitted light ray, 413*c*: transmitted light ray, 413*d*: transmitted light ray, 5000: pyramidal projection, 5100: apex, 5200: conical projection, 5230: quadrangular pyramidal projection, 5250: triangular pyramidal projection, 5300: pyramidal projection, 5301: pyramidal projection, 9101: main body, 9102: display portion, 9201: main body, 9202: display portion, 9301: main body, 9302: display portion, 9401: main body, 9402: display portion, 9501: main body, 9502: display portion, 9701: display portion, 9702: display portion, 5001*a*: pyramidal projection, 5001*f*: pyramidal projection, 5101*a*: apex, 5101*f*: apex, 5201*a*: conical projection, 5201*f*: conical projection, 5231*a*: quadrangular pyramidal projection, 5231*h*: quadrangular pyramidal projection, 5251*a*: triangular pyramidal projection, and 51511: triangular pyramidal projection

The invention claimed is:

1. A plasma display comprising:

a pair of substrates;

at least a pair of electrodes provided between the pair of substrates;

a phosphor layer provided between the pair of electrodes; and an anti-reflection layer provided on an outer side of one substrate of the pair of substrates, wherein the one substrate has a light-transmitting property, wherein the anti-reflection layer comprises a plurality of pyramidal projections, wherein each side of a base of one of the plurality of pyramidal projections is in contact with one side of a base of another pyramidal projection, wherein a space among the plurality of pyramidal projections is filled with a protective layer having a lower refractive index than a refractive index of the plurality of pyramidal projections, and wherein each of the refractive index of the plurality of pyramidal projections and the protective layer increases in direction from an apical portion of each of the plurality of pyramidal projections to the base of each of the plurality of pyramidal projections.

2. A plasma display according to claim 1, wherein apexes of the plurality of pyramidal projections are arranged at an equal distance.

3. A plasma display according to claim 1, wherein each of the plurality of pyramidal projections has a hexagonal pyramidal shape.

4. The plasma display according to claim 2, wherein a distance between the apexes of the plurality of pyramidal projections is 350 nm or less.

5. The plasma display according to claim 3, wherein a filling factor of bases of the plurality of pyramidal projections per unit area is 80% or more.

6. The plasma display according to claim 3, wherein a first vertex of a hexagonal base of one of the plurality of pyramidal projections is in contact with a first vertex of a hexagonal base of an adjacent pyramidal projection, and wherein a second vertex of the hexagonal base of the one of the plurality of pyramidal projections is in contact with a second vertex of the hexagonal base of the adjacent pyramidal projection.

7. A field emission display comprising:

a first substrate;

an electron-emission element over the first substrate;

a phosphor layer over the electron-emission element;

an electrode over and in contact with the phosphor layer;

a second substrate over the electrode; and an anti-reflection layer provided over the second substrate, wherein the second substrate has a light-transmitting property, wherein the anti-reflection layer comprises a plurality of pyramidal projections, wherein each side of a base of one of the plurality of pyramidal projections is in contact with one side of a base of another pyramidal projection, wherein a space among the plurality of pyramidal projections is filled with a protective layer having a lower refractive index than a refractive index of the plurality of pyramidal projections, and wherein each of the refractive index of the plurality of pyramidal projections and the protective layer increases in direction from an apical portion of each of the plurality of pyramidal projections to the base of each of the plurality of pyramidal projections.

8. A field emission display according to claim 7, wherein apexes of the plurality of pyramidal projections are arranged at an equal distance.

9. A field emission display according to claim 7, wherein each of the plurality of pyramidal projections has a hexagonal pyramidal shape.

10. The field emission display according to claim 8, wherein a distance between the apexes of the plurality of pyramidal projections is 350 nm or less.

11. The field emission display according to claim 9, wherein a filling factor of bases of the plurality of pyramidal projections per unit area is 80% or more.

12. The field emission display according to claim 9, wherein a first vertex of a hexagonal base of one of the plurality of pyramidal projections is in contact with a first vertex of a hexagonal base of an adjacent pyramidal projection, and wherein a second vertex of the hexagonal base of the one of the plurality of pyramidal projections is in contact with a second vertex of the hexagonal base of the adjacent pyramidal projection.

13. The plasma display according to claim 1, wherein a height of the plurality of pyramidal projections is higher than 1000 nm.

14. The field emission display according to claim 7, wherein a height of the plurality of pyramidal projections is higher than 1000 nm.

15. The plasma display according to claim 13, wherein the height of the plurality of pyramidal projections is greater than or equal to 1600 nm and less than or equal to 2000 nm.

16. The plasma display according to claim 14, wherein the height of the plurality of pyramidal projections is greater than or equal to 1600 nm and less than or equal to 2000 nm.

* * * * *